US007635137B2

(12) United States Patent
Gregory et al.

(10) Patent No.: US 7,635,137 B2
(45) Date of Patent: Dec. 22, 2009

(54) DISASSEMBLABLE SKATEBOARD FOR IMPROVED PORTABILITY

(75) Inventors: Brett J. Gregory, Valencia, CA (US); Michael W. Keever, Chino, CA (US)

(73) Assignee: Portaboard, L.L.C., Valencia, CA (US)

( * ) Notice: Subject to any disclaimer, the term of this patent is extended or adjusted under 35 U.S.C. 154(b) by 608 days.

(21) Appl. No.: 11/197,578

(22) Filed: Aug. 3, 2005

(65) Prior Publication Data

US 2007/0029749 A1 Feb. 8, 2007

(51) Int. Cl.
*B62M 1/00* (2006.01)

(52) U.S. Cl. ..... 280/87.05; 280/87.042; 280/87.041

(58) Field of Classification Search ..... 280/87.01, 280/87.021, 87.03, 87.041, 87.05, 87.042
See application file for complete search history.

(56) References Cited

U.S. PATENT DOCUMENTS

| | | | | | |
|---|---|---|---|---|---|
| 2,114,586 | A | * | 4/1938 | Bowen | 280/47.371 |
| 2,516,644 | A | * | 7/1950 | Post et al. | 280/11.209 |
| 3,313,510 | A | * | 4/1967 | Mudano | 248/244 |
| 3,565,454 | A | * | 2/1971 | Stevenson et al. | 280/87.042 |
| 3,801,117 | A | * | 4/1974 | Pierce | 280/603 |
| 4,161,326 | A | * | 7/1979 | Gaber | 280/87.042 |
| 4,358,130 | A | * | 11/1982 | Adams | 280/603 |
| 4,458,907 | A | | 7/1984 | Meredith | |
| 5,022,668 | A | * | 6/1991 | Kenny | 280/7.14 |
| 5,505,474 | A | | 4/1996 | Yeh | |
| 5,540,455 | A | | 7/1996 | Chambers | |
| 5,769,438 | A | | 6/1998 | Svetlov | |
| 6,131,931 | A | | 10/2000 | Globerson | |
| D473,905 | S | | 4/2003 | Schnuckle | |
| 6,631,913 | B2 | | 10/2003 | Godfrey | |
| D505,470 | S | | 5/2005 | Hong | |
| 7,070,193 | B2 | * | 7/2006 | Yamaguchi | 280/87.042 |
| 7,121,909 | B1 | * | 10/2006 | Meyerhoffer | 441/74 |
| 2003/0127816 | A1 | | 7/2003 | Schnuckle | |
| 2005/0212246 | A1 | * | 9/2005 | Hong | 280/87.042 |

OTHER PUBLICATIONS

Stowboards Internet pages from Stowboards.com, printed Jun. 1, 2005, 7 pages, Stowboards.com, US.

* cited by examiner

*Primary Examiner*—Christopher P Ellis
*Assistant Examiner*—Vaughn T Coolman
(74) *Attorney, Agent, or Firm*—Richard A. Ryan

(57) ABSTRACT

A skateboard that may be easily assembled and disassembled without tools for portability comprises a multiple section deck having one or more mounting mechanisms thereon that are configured for releasably mounting a truck mounting assembly thereto so as to join two deck sections together. The truck mounting assembly has a standard truck assembly and a truck mount attached or integral therewith. The truck mount is configured to engage the mounting mechanism. A securing mechanism secures the truck mounting assembly to the deck to provide an assembled skateboard suitable for riding. In a preferred embodiment, the truck mount has a mounting cavity for receiving a truck mount connector therein and an outwardly extending member configured to engage a securing assembly attached to the deck. The skateboard is made out of lightweight materials and with disassemblable components so it may be easily carried in a backpack or other carrying case.

46 Claims, 14 Drawing Sheets

DISASSEMBLABLE SKATEBOARD FOR IMPROVED PORTABILITY

CROSS-REFERENCE TO RELATED APPLICATIONS

None.

BACKGROUND OF THE INVENTION

A. Field of the Invention

The field of the present invention relates generally to human powered sports and recreational vehicle devices, particularly skateboards and the like. More particularly, the present invention relates to skateboards that are configured to be easily carried and stored when not in use. Even more particularly, the present invention relates to such skateboards having components that are configured for easy assembly into a skateboard and disassembly into its separate components so that the skateboard may be carried in a backpack or like carrying case when not in use.

B. Background

Skateboards are one of the most popular forms of human powered sports and recreational devices that are utilized by a rider to move himself or herself across the ground or other surface. The standard skateboard has an elongated platform having a top surface on which the rider stands and a bottom surface that connects to one or more wheel assemblies that roll across the ground. The platform is sized to allow the rider to be able to place all or a portion of both of his or her feet on the upper surface when riding the skateboard. As well known by persons familiar with skateboards, the rider uses one of his or her feet to propel the skateboard and uses the tilting action of his or her body, usually with both feet generally transversely disposed on the platform, to change the skateboard's direction of travel. Although in the past the platform was almost always configured to be substantially planar and made out of wood, modern skateboards are known to have a variety of shapes, including generally uplifting ends, and be made out of a variety of different types of materials, including various metal, thermoplastic and composite materials. The typical wheel assembly comprises a pair of truck mechanisms having a plurality of wheels, typically two for each truck, that are rotatably connected to the truck axle. For the standard skateboard, the truck mechanisms are fixedly attached to the underside of the board with mechanical connectors, such as rivets, screws or bolts, or specially configured adhesives. Some modern skateboards are configured with truck assemblies that provide for a pivoting type of motion relative to the plane of the surface on which the skateboard is being ridden to allow the rider more control of the skateboard's movement.

Although skateboard riding is popular among people of all ages, it tends to be most popular among younger riders who like to ride the skateboard as a means of transportation to get to school, stores, after school sports practices, movies and other activities in addition to use for general recreation. A significant problem for use of a skateboard as a means of transportation, for riders of all ages, is what to do with the skateboard once the rider gets to where he or she is going. Although most people can carry the standard skateboard, it is not necessarily small or lightweight and most people do not want to carry a skateboard around with them while they walk to and from classes or around the store or other activity. Storage of the skateboard in a locker or other container is generally not practical. Most skateboards are not configured for attachment to bicycle racks or other storage areas. To compound the problem, many of the destinations typically where a rider is likely to go, such as schools and stores, do not allow skateboard riding on the premises. This is a particular problem with regard to schools, which is perhaps the most convenient and logical destination for younger skateboard riders, which often have very strict rules regarding the riding or even carrying of skateboards on the campus due to safety and discipline concerns. Many stores, malls and like areas also do not want their patrons to be walking around carrying a skateboard. Because there is typically no real satisfactory outside storage solution that provides convenient and safe (i.e., to avoid theft or persons tripping over the skateboard) storage of the rider's skateboard, the utility of a skateboard as a means of transportation to get to school, stores and other destinations is generally substantially limited.

Due to the aforementioned carrying and storage problems, there is a need to provide a skateboard that is easier to carry and store. A number of patents are directed to skateboards that are configured to be detachable or foldable so as to be more easily carried and stored by the rider when not in use. For instance, U.S. Pat. No. 6,631,913 to Godfrey describes a detachable interchangeable skateboard having an H-shaped locking brace that interconnects two halves of the skateboard, each having a top and bottom platform, configured to allow the user to change the top platform to change the look of the skateboard and/or replace worn components. The wheel assemblies are attached to the lower platform. U.S. Pat. No. 6,131,931 to Globerson, et al. describes a folding skateboard having a three-piece platform with the sections hinged together and configured such that when the skateboard is folded the trucks and wheels of the skateboard, which are attached to the front and back platform sections, are adjacent to each other. Rods, clips or other members hold the skateboard in its folded configuration. U.S. Pat. No. 5,769,438 to Svetlov describes a three-piece folding skateboard that has a locking mechanism that extends or retracts a pair of rods from a pair of receiving elements to secure the skateboard in an extended position or to allow the user to fold the skateboard. U.S. Pat. No. 5,505,474 to Yeh describes a folding skateboard that has a frame made up of frame bars connected by links and a pair of pivoting couplings that connect the wheel assemblies to the frame. A foot plate is supported by each of the wheel assemblies. U.S. Pat. No. D505,470 to Hong illustrates a folding skateboard having a three-piece platform with hinges on top to foldably connect the platform sections. U.S. Pat. No. D473,905 and U.S. Publication No. 2003/0127816, both to Schnuckle, et al., describe foldable skateboards of substantially different configuration than the standard skateboard that has an articulating structure that can be folded for carrying or storage. The skateboard described in the Schnuckle patents appears to be available as the Stowboard™, available from Stowboards.com. U.S. Pat. No. 5,540,455 to Chambers describes an articulating skateboard that articulates and pivots. U.S. Pat. No. 4,458,907 to Meredith describes a skateboard that allows the user to extend or retract the length of the platform.

While the foregoing patents generally describe detachable or foldable skateboards that may reduce the overall length of the skateboard, the folded condition of the skateboards appear to be somewhat bulky and, as a result, not necessarily much easier to carry than a conventional skateboard. The bulky nature of these skateboards is because, at least in part, the truck or wheel assemblies are not configured for easy removal. In fact, no known skateboard provides an assembly for easily and quickly removing the truck wheel assemblies from the platform. In addition, some of the foregoing appear to have folding or bending apparatuses that provide a skateboard which is not fully secured when it is placed in the extended, riding position. This would appear to present problems from a riding enjoyment and safety standpoint.

What is needed, therefore, is a skateboard that is more fully disassemblable so as to better facilitate carrying and storage of the skateboard when it is not in use and which can be securely placed in the rideable position when assembled. The preferred disassemblable skateboard should have components that are easily and quickly assembled and disassembled without the use of any tools. The preferred skateboard should be adaptable for being manufactured out of relatively lightweight, strong materials to reduce the burden on the user when he or she is carrying the skateboard when not in use. The preferred skateboard should also be adaptable for fitting into a backpack or like carrying case without unduly utilizing much of the available carrying space. The preferred portable skateboard should be adaptable for use with a variety of different types and styles of skateboard platforms and truck assemblies.

SUMMARY OF THE INVENTION

The disassemblable skateboard for improved portability of the present invention solves the problems and provides the benefits identified above. That is to say, the present invention discloses an improved portable skateboard that is easily and quickly disassembled into relatively easy to carry and store components that can be easily and quickly reassembled into the skateboard for riding. The portable skateboard of the present invention can be assembled and disassembled without the use of tools and, when assembled, provides a secure, stable platform for safely riding the skateboard. In the preferred embodiment, the disassembled components of the portable skateboard can be conveniently stored in a backpack or other carrying case or storage container, including lockers and the like, when not in use. Preferably, the portable skateboard of the present invention is made out of strong, lightweight materials and configured so as to reduce the weight of the skateboard to be easily carried when it is not in use. In a preferred embodiment, the portable skateboard of the present invention has a pair of truck assemblies that separate from a three-piece, separatable platform, with the truck assemblies configured to securely join adjacent sections of the platform together into a unified skateboard. The portable skateboard of the present invention can be used with a variety of different types and styles of skateboard platforms and truck assemblies.

In one general aspect of the present invention, the disassemblable skateboard for improved portability includes a deck comprised of a first end section, a second end section and a center section disposed therebetween. The deck sections are configured to join to together to form an integral deck suitable for riding. A first mounting mechanism is at the junction of the first end section and the second end section and a second mounting mechanism is at the junction of the second end section and center section. A first truck mounting assembly, having a truck mount, truck base, axle and one or more wheels rotatably attached to the axle, mounts to the first mounting mechanism in a manner that abuttingly joins the first end section to the center section. A second truck mounting assembly, also having a truck mount, truck base, axle and one or more wheels rotatably attached to the axle, mounts to the second mounting mechanism in a manner that abuttingly joins the second end section to the center section. A first securing mechanism secures the first truck mounting assembly to the bottom surface of the deck and a second securing mechanism secures the second truck mounting assembly to the bottom surface of the deck. In one of the preferred embodiments, each of the first and second mounting mechanisms comprises an outwardly projecting truck mount connector that is engagedly received in a mounting cavity on the truck mount such that the truck mounting assemblies are mounted to the deck using a twist-and-lock type of engagement. Also in one of the preferred embodiments, each of the truck mounting assemblies comprises a generally resilient outwardly extending member that is configured to engage a securing assembly so as to secure the truck mounting assemblies to the bottom surface of the deck. Preferably, the outwardly extending members have a locking projection that engages a locking cavity on the securing assembly. The resilient nature of the outwardly extending member assisting in pushing the locking projection into the locking cavity. In another embodiment, the securing assembly comprises a ramp section that guides the locking projection into engagement with the locking cavity. The securing assembly can also comprise an extension member, which is slidably engaged in a base member attached to the bottom surface of the deck, that is configured to engage a locking aperture on the truck mount of each of the truck mounting assemblies. In yet another embodiment, the securing assembly comprises a pair of deck receptacles in the bottom surface of the deck and the truck mount of the truck mounting assemblies include a pair of outwardly extending bracket extensions that are configured to be received in the deck receptacles so as to join adjacent sections of the deck together. The securing assembly can also include an extension member attached to a securing latch that is biased by one or more springs to drive the extension member into a locking aperture located on the side of the truck mount component of the truck mounting assemblies.

Accordingly, the primary objective of the present invention is to provide a portable, disassemblable skateboard that provides the advantages discussed above and that overcomes the disadvantages and limitations associated with presently configured skateboards, including foldable, disassemblable or otherwise portable skateboards.

It is also an object of the present invention to provide a portable skateboard that is quickly and easily assembled into a secure, stable skateboard for riding or quickly and easily disassembled into separate components for storage and carrying.

It is also an object of the present invention to provide a portable skateboard that is quickly and easily assembled or disassembled without the use of tools or other devices.

It is a further object of the present invention to provide a portable skateboard comprising a multiple piece platform that is separatable from the truck assemblies so as to facilitate easy carrying and storage of the skateboard when not in use, including storage of the components in a backpack or other suitable carrying case.

It is a further object of the present invention to provide a portable skateboard which is adaptable for use with a variety of different types and styles of skateboards and truck assemblies.

It is a further object of the present invention to provide a portable skateboard having truck mounting mechanisms that allow the user to quickly and easily remove the truck assemblies from the skateboard platform so as to reduce the bulk thereof for easier carrying and storing of the skateboard.

It is a further object of the present invention to provide a portable skateboard having a multiple component platform and a pair of truck mounting mechanisms that are configured to securely join adjacent platform components together to provide a stable and safely rideable skateboard.

It is a further object of the present invention to provide a portable skateboard having a locking mechanism which lockingly engages a truck mount attached to the truck assembly to secure the truck mount to a multiple piece platform so as to securely connect the pieces into a single, stable platform for skateboard riding.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, and particularly with regard to the embodiment of the disassemblable skateboard for improved portability of the present invention illustrated in the figures, various preferred embodiments of the present invention are set forth below. The enclosed description and drawings are merely illustrative of preferred embodiments and represent several different ways of configuring the present invention. Although specific components, materials, configurations and uses of the present invention are illustrated and set forth in this disclosure, it should be understood that a number of variations to the components and the configuration of those components described herein and in the accompanying figures can be made without changing the scope and function of the invention set forth herein.

Figure 1:
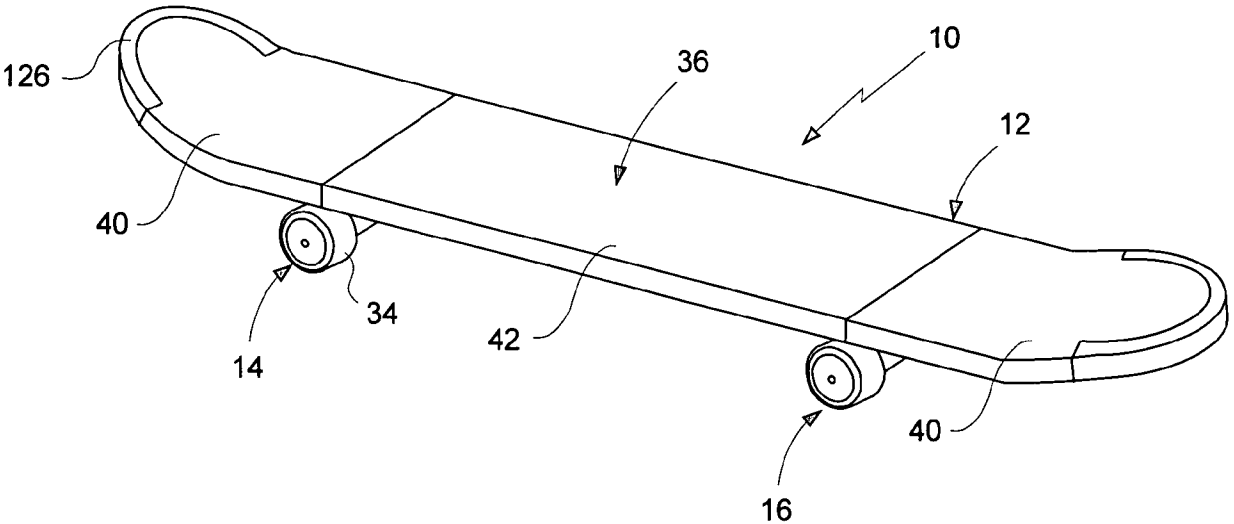
FIG. 1 is top perspective view of the disassemblable skateboard for improved portability configured according to a preferred embodiment of the present invention shown in its assembled condition.
Figure 2:
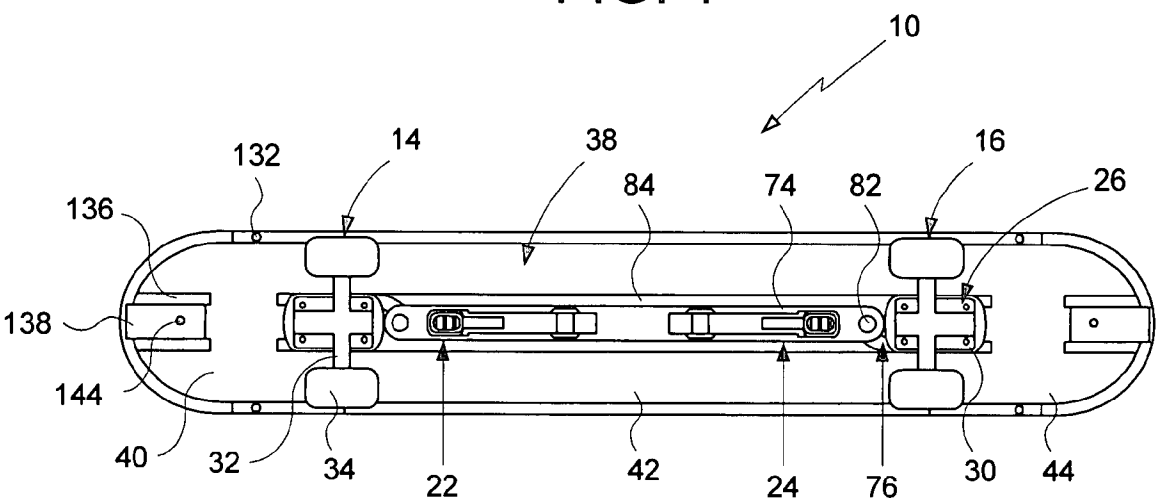
FIG. 2 is a bottom view of the disassemblable skateboard of FIG. 1 showing the truck mounting assemblies mounted and secured to the platform.
Figure 8:
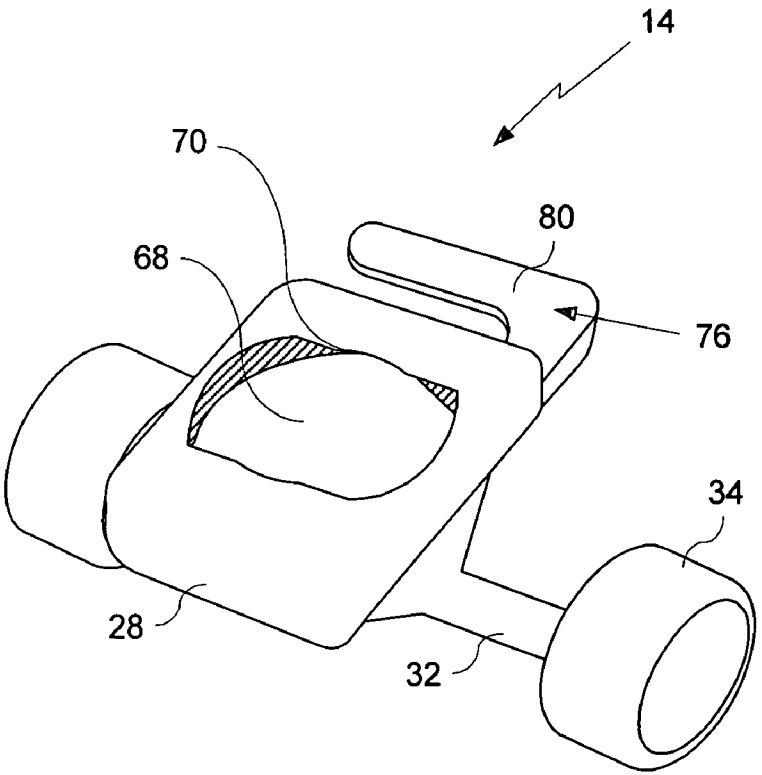
FIG. 8 is a top perspective view of the truck mounting assembly of FIG. 7.
Figure 7:
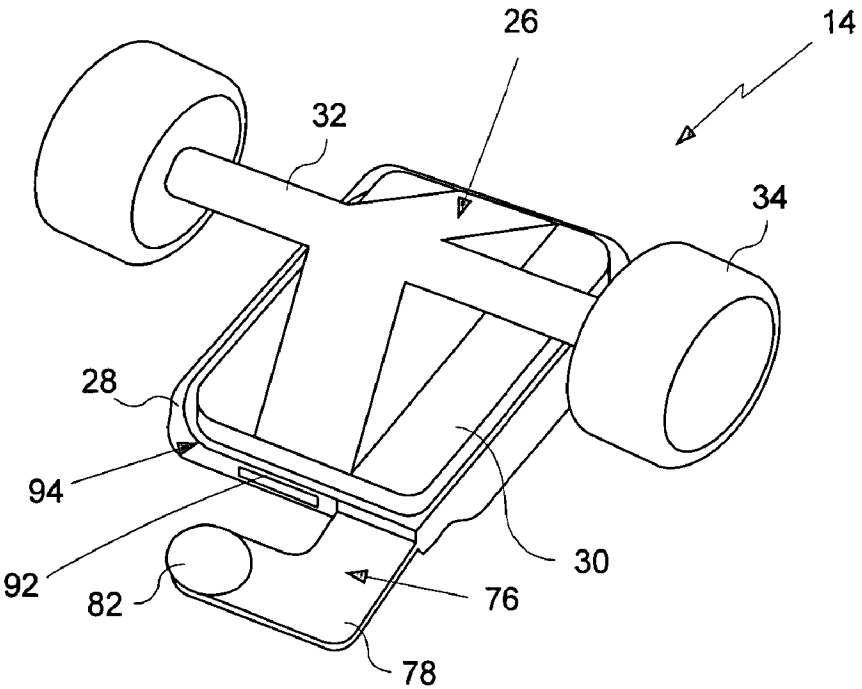
FIG. 7 is a bottom perspective view of one of the truck mounting assemblies of the disassemblable skateboard of FIG. 2.

In the preferred embodiments of the disassemblable skateboard for improved portability of the present invention, shown in the figures, the portable skateboard is identified generally as 10. FIGS. 1 and 2 included herewith show a preferred embodiment of portable skateboard 10 in its assembled or rideable condition, with the front or forward end of skateboard 10 on the left and the back or rearward end of skateboard 10 on the right. As shown in FIGS. 1 through 4, portable skateboard 10 primarily comprises deck 12, front or first truck mounting assembly 14, rear or second truck mounting assembly 16, front or first mounting mechanism 18, rear or second mounting mechanism 20, front or first securing mechanism 22 and rear or second securing mechanism 24. As shown in FIGS. 7 and 8 with regard to first truck mounting assembly 14, with second truck mounting assembly 16 being configured the same, first 14 and second 16 truck assemblies comprise a truck assembly 26 attached to or integral with truck mount 28. Truck assembly 26 of the preferred embodiment of the present invention is a standard truck assembly that comprises a truck base 30, axle 32 and a pair of wheels 34 rotatably attached to axle 32. As well known in the art, the heretofore available skateboards and truck assemblies are configured such that truck base 30 is attached directly to deck 12, with wheels 34 extending outwardly therefrom for riding on a sidewalk, street or other surface. Although truck assembly 26 for first 14 and second 16 truck mounting assemblies may be specially configured for skateboard 10 of the present invention, it is preferred that truck assembly 26 be one of the standard, typical or "high tech" truck assemblies in use with presently available skateboards so as to reduce the cost and obtain the benefit of such presently existing truck assemblies. As shown in the figures, it is preferred that truck mount 28 be a separate component and truck base 30 be fixedly attached thereto in the same manner as truck base 30 for current truck assemblies 26 attach to deck 12 (i.e., using screws, bolts, rivets, adhesives or other connecting mechanisms). In an alternative embodiment, truck mount 28 can be made integral with truck assembly 26 such that truck mount 28 and truck assembly 26 are a single component which attaches to deck 12 in the manner described below with regard to the preferred embodiment. As set forth below, truck mount 28 is configured to removably attach to first mounting mechanism 18 or second mounting mechanism 20 so the user of skateboard 10 can remove first truck mounting mechanism 14 and second truck mounting mechanism 16 to reduce the size and configuration of skateboard 10 to make it easier to carry.

As well known in the art, deck 10 has a top surface 36 configured for the user to stand on and a bottom surface 38 to which, in the typical prior art skateboard, truck base 30 of truck assembly 26 attaches. In one configuration of the present invention, skateboard 10 has a single piece deck 12 with removable first 14 and second 16 truck mounting assemblies that enable the user to reduce the weight and bulk of skateboard 10 so as to more easily carry the components (i.e., deck 12, first truck mounting assembly 14 and second truck mounting assembly 16) separately for ease in distributing the weight and fitting within a backpack or other carrying case. As known to those familiar with skateboards, typically the conventional truck assemblies are only removable by use of a screwdriver, wrench, hex driver or some other tool. Use of the single piece deck 12 with first 18 and second 20 mounting mechanisms and first 14 and second 16 truck mounting assemblies of the present invention, as described in more detail below, allows the user to quickly and easily assemble skateboard 10 for riding or to quickly and easily disassemble skateboard 10 for storage or carrying. The heretofore available skateboards do not allow the user to essentially reduce skateboard 10 to a generally flat deck 12 and separate first 14 and second 16 truck mounting assemblies in a quick and easy manner. Once separated or disassembled, the deck 12 can be-carried in a compartment separate from first 14 and second 16 truck mounting assemblies.

Figure 15:
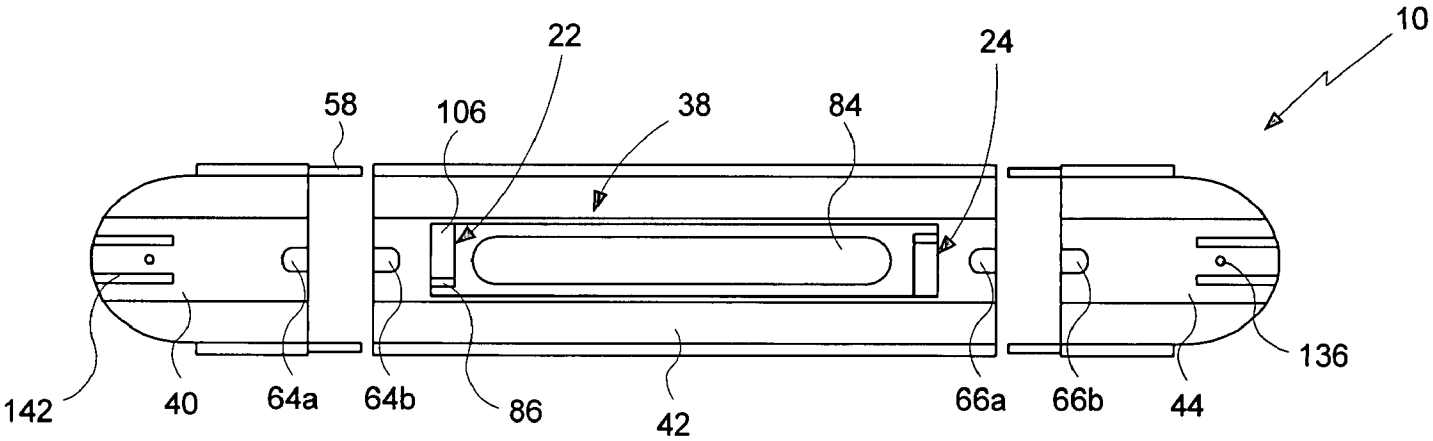
FIG. 15 is an exploded view of the platform utilized with the embodiment of the disassemblable skateboard shown in FIG. 14.
Figure 18:
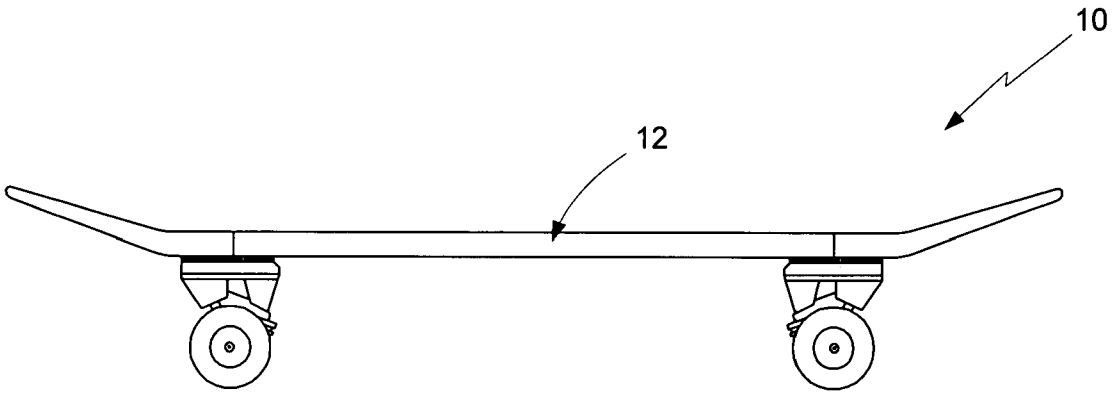
FIG. 18 is a side view of another alternative embodiment of the disassemblable skateboard of the present invention.

In a preferred embodiment of the present invention, skateboard 10 has a deck 12 which can be separated into two or more separate deck sections. In the preferred embodiment, deck 12 can be separated into three deck sections, namely forward or first end section 40, center section 42 and rearward or second end section 44, as best shown in the exploded views of FIGS. 4 and 15 and the partially exploded view of FIG. 20. For purposes of describing the embodiments herein, first end section 40 has a first end 46 and a second end 48, center section 42 has a first end 50 and a second end 52, and second end section 44 has a first end 54 and second end 56. In this embodiment, first truck mounting assembly 14 is utilized to abuttingly join the second end 48 of first end section 40 to the first end 50 of center section 42 and second truck mounting assembly 16 is utilized to abuttingly join the second end 52 of center section to first end 54 of second end section 44 to provide a substantially unified deck 12, as best shown in FIGS. 1 and 2. Various configurations for first 14 and second 16 truck assemblies, in conjunction with first 18 and second 20 mounting mechanisms, can be utilized to accomplish the secured joined deck sections to provide a stable and safe to use deck 12 and accomplish the easy and quickly assembly and disassembly objectives desired for the improved portable skateboard 10 of the present invention. Preferred configurations for these components are set forth in more detail below and in the accompanying figures. As known to those skilled in the art, assembled deck 12 can be configured so as to be generally planar throughout its length or first 40 and second 44 end sections can be configured to be slightly to somewhat inclined, as best shown in FIG. 18, with only center section 42 being generally planar to achieve certain aesthetic and performance objectives for skateboard 10.

To ensure that skateboard 10 is safe and suitable for riding use, it is important that first 14 and second 16 truck mounting assemblies be cooperatively configured with first 18 and second 20 mounting mechanisms, respectively, such that once the separate sections of deck 12 are joined they are held tightly against each other and are locked and remain locked in such abutting relation until the user desires to disassemble skateboard 10 for carrying or storage. As would be understood by those skilled in the art, gaps between the joined sections (such as first end section 40 and center section 42) could create problems and be unsafe for the rider, particularly if barefoot. Likewise, the enjoyment and safety of skateboard 10 would be substantially reduced if deck 12 of skateboard 10 were to separate or tend to separate unexpectedly during use. To prevent such occurrences, it is preferred that skateboard 10 utilizes a more than one system of locking or securing first 14 and second 16 truck assemblies onto bottom surface 38 of deck 12, particularly when such assemblies are used to securely join deck sections, such as 40, 42 and 44, together into unified deck 12.

Figure 3:
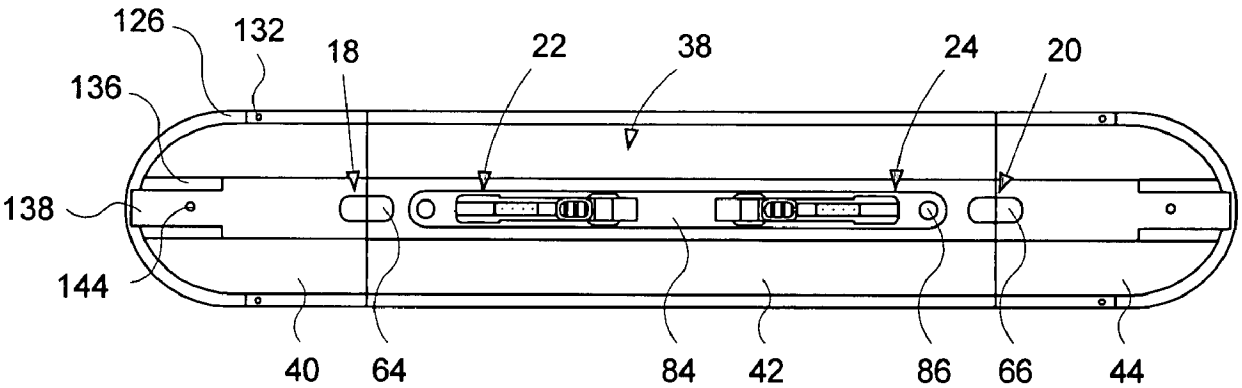
FIG. 3 is a bottom view of the disassemblable skateboard of FIG. 2 showing the platform with the truck assemblies removed from the truck mount connectors.
Figure 4:
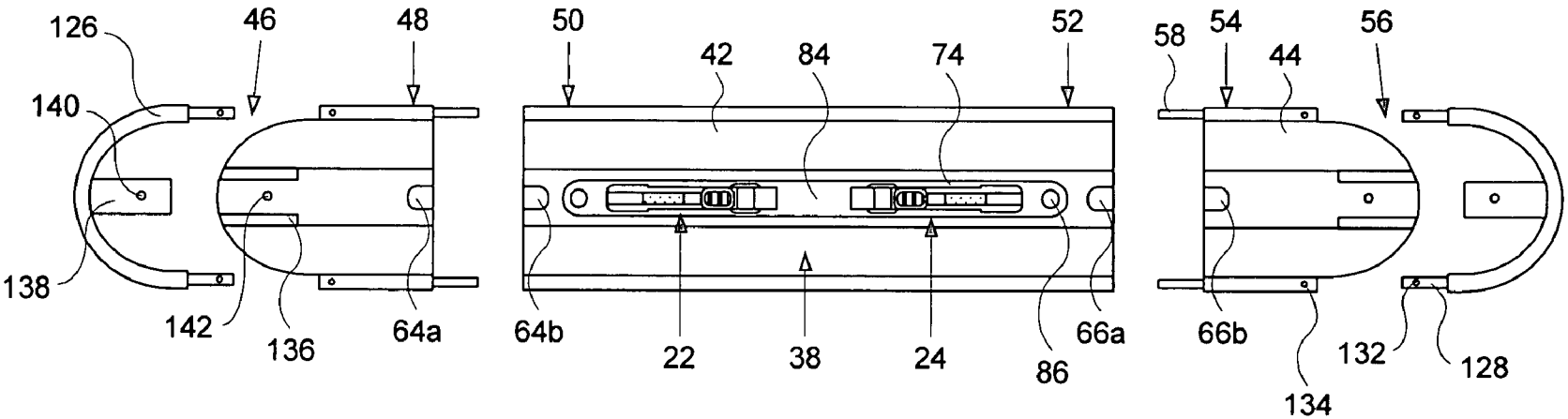
FIG. 4 is an exploded view of the disassemblable skateboard of FIG. 3 particularly showing the separate sections of the deck.
Figure 6:
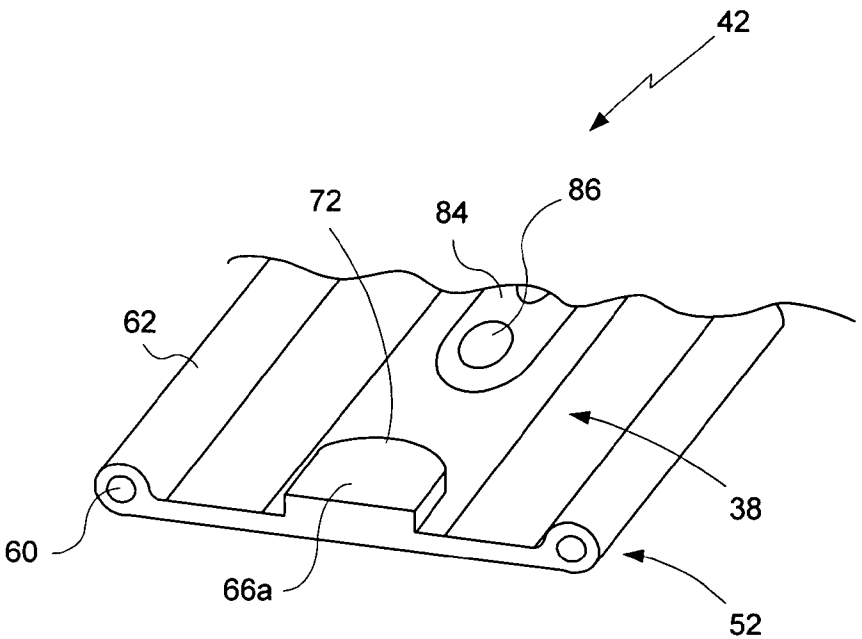
FIG. 6 is a rear perspective view of the second end of the center section of the deck of the disassemblable skateboard of FIG. 4.
Figure 5:
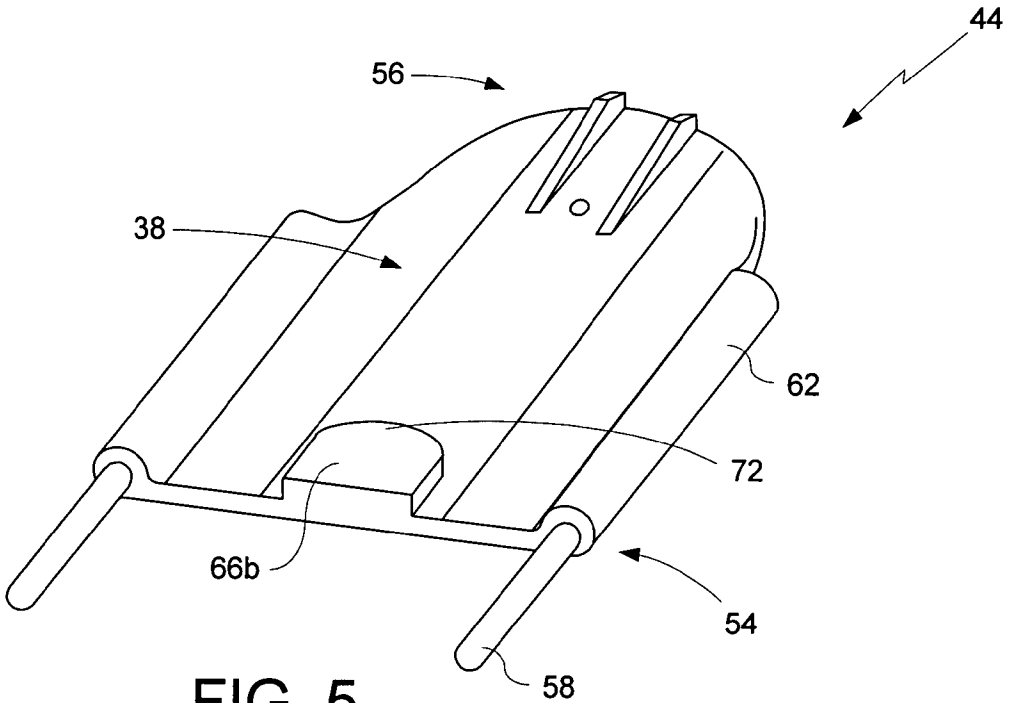
FIG. 5 is a front perspective view of the first end of the rearward end section of the deck of the disassemblable skateboard of FIG. 4.
Figure 19:
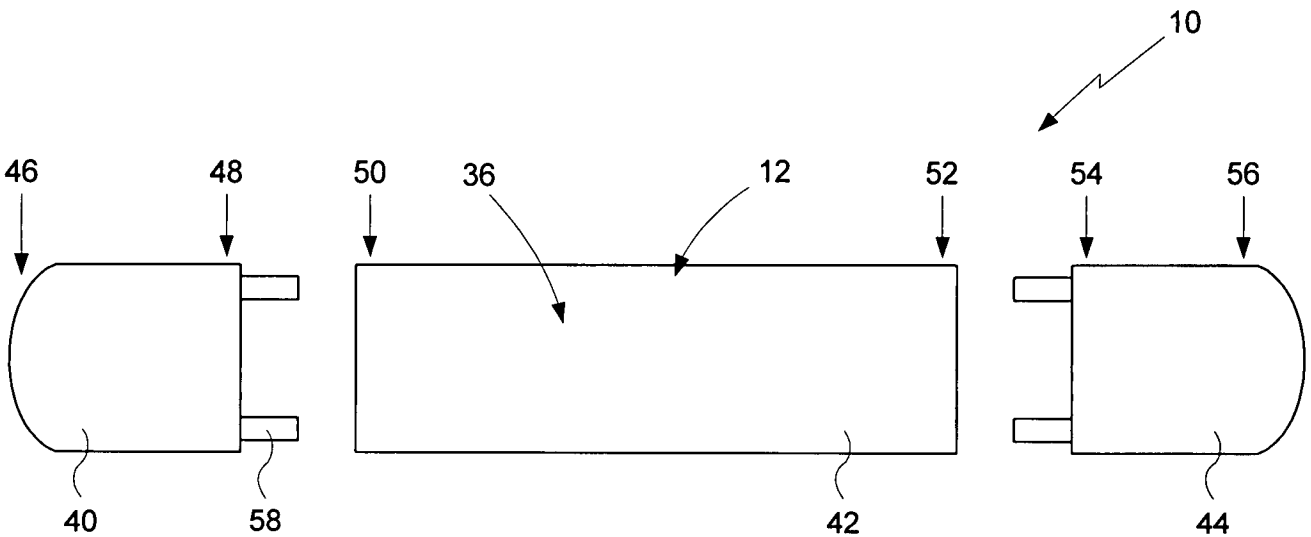
FIG. 19 is a top view of the three platform components of the disassemblable skateboard of the embodiment of the present invention shown in FIG. 18.
Figure 20:
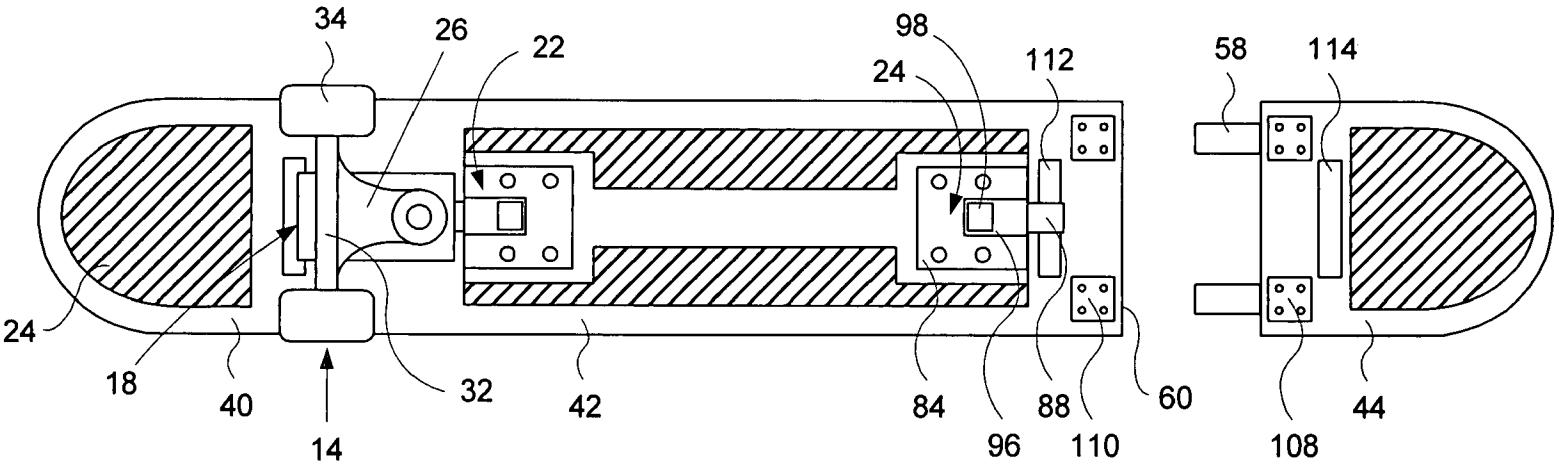
FIG. 20 is a partially exploded bottom view of the disassemblable skateboard of the embodiment of the present invention of FIG. 18 shown with the forward truck mounting assembly mounted to the platform and the rearward end section of the platform separated from the center section of the platform.

In the preferred embodiment, shown in FIGS. 1 through 12, deck 12 is provided in three separatable sections, first end section 40, center section 42 and second end section 44, that are guided into the desired abutting relationship by use of a pin and socket type of arrangement. As best shown in FIGS. 5 and 6 with regard to second end section 44 and center section 42, respectively, the first end 54 of second end section 44 is provided with an outwardly extending pin 58 and second end 52 of center section 42 is provided with a cooperatively configured socket 60 which receives pin 58 therein when second end section 44 is joined to center section 42. As shown in FIG. 4, second end 48 of first end section 40 also has pins 58 and first end 50 of center section 42 also has sockets 60 to join first end section 40 to center section 42. In a preferred embodiment of deck 12, for ease of manufacturing the outer edges 62 of deck 12 are configured to be generally tubular with the channel therein forming socket 60. Pin 58 can be co-formed (i.e., co-extruded or the like) with edges 62 or pin 58 can be fixedly inserted inside the channel of tubular edge 62 using adhesives or other materials suitable for fixing pin 58 inside the channel (i.e., socket 60) of tubular edge 62. In the embodiment of FIGS. 5 and 6, pin 58 is a generally elongated, cylindrically shaped outwardly extending member and socket 60 is configured to be a cooperatively sized (i.e., such that pin 58 has a diameter that is slightly smaller than that of socket 60) opening such that pin 58 is slidably received in socket 60 to reduce the amount of unwanted flexing between second end section 44 and center section 42. However, the invention is not so limited. As will be readily apparent to those skilled in the art, the pin 58 and socket 60 configuration described above can be modified in a number of different ways to accomplish the objectives herein, namely guiding the separate sections of deck 12 together into abutting relationship. For instance, the location of pin 58 and socket 60 can be reversed, such that first 50 and second 52 ends of center section 42 have pins 58 and second end 48 of first end section 40 and first end 54 of second end section 44 have the sockets. In addition, as shown in FIGS. 19 and 20, pin 58 can be a generally rectangular, flat outwardly extending member that is received by a cooperatively configured, generally rectangularly shaped opening that receives the pin 58 therein. Various other combinations are also possible.

In the preferred embodiments of the skateboard 10 of the present invention, pins 58 and sockets 60 described above are utilized merely to guide adjoining sections of deck 12 together. The cooperatively configured truck mounting assemblies and mounting mechanisms, such as first truck mounting assembly 14 and first mounting mechanism 18, are utilized to attach the respective truck assemblies 26 to deck 12 and maintain the separate sections of deck 12 in their abutting relationship so as to form a unified deck 12. In the preferred embodiment, first 18 and second 20 mounting mechanisms each comprise an outwardly projecting truck mount connector, such as first truck mount connector 64 and second truck mount connector 66, attached to bottom surface 38 of deck 12, as best shown in FIG. 3. As set forth below, truck mount 28 of each of first 14 and second 16 truck mounting assemblies is configured to engage first 64 and second 66 truck mount connectors, respectively, to removably mount truck assemblies 26 to deck 12. For a one-piece deck 12, first 64 and second 66 truck mount connectors will generally be a single component. For the preferred embodiment, with deck 12 in multiple sections such as shown in FIG. 4, first 64 and second 66 truck mount connectors are provided in multiple components, such as 64*a* at second end 48 of first end section 40 and 64*b* at first end 50 of center section 42 for first mounting mechanism 18 and 66*a* at second end 52 of center section 42 and 66*b* at first end 54 of second end section 44 for second mounting mechanism 20. In this manner, when first 40 and second 44 end sections are joined to center section 42, truck mount components 64*a* and 64*b* will be abutting to form first truck mount connector 64 and truck mount components 66*a* and 66*b* will be abutting to form second truck mount connector 66. In the preferred embodiment, truck mount 28 of first truck mounting assembly 14 will mount to first truck mount connector 64 and second truck mounting assembly 16 will mount to second truck mount connector 66 in a manner that cooperatively engages truck mount 28 so as to hold first end section 40 to center section 42 and center section 42 to second end section 44 to form the unified deck 12.

In the preferred embodiment of the present invention, first 14 and second 16 truck mounting assemblies cooperatively engage first 18 and second 20 mounting mechanisms, respectively, through a twist-and-lock type of connection. To provide this type of connection, each truck mount 28 of first 14 and second 16 truck mount assemblies has a mounting cavity 68 with one or more receiving lips 70, best shown in FIG. 8, and each of first 64 and second 66 truck mount connectors have one or more projecting lips 72. In the preferred embodiment, as shown, mounting cavity 68 has a pair of opposite disposed receiving lips 70 and each of first 64 and second 66 truck mount connectors have a pair of opposite disposed projecting lips 72. Mounting cavity 68 truck mount 28 is sized and configured to receive first 64 or second 66 truck mount connectors therein, depending on whether it is first 14 or second 16 truck mounting assembly. As known to those familiar with twist-and-lock operation, mounting cavity 68 is configured to be placed over first 64 or second 66 truck mount connectors at a right angle to the normal, mounted direction and then first 14 or second 16 truck mounting assembly is twisted to place the assemblies in the correct direction such that projecting lips 72 of first 64 or second 66 truck mount connectors engage receiving lips 70 of mounting cavity 68 on truck mount 28 by receiving lips 70 slidably moving under projecting lips 72. Receiving lips 70 and projecting 72 should be configured such that receiving lips 70 of mounting cavity 68 are securely engaged by projecting lips of first 64 or second 66 truck mount connectors to tightly abut the sections of deck 12 together and hold first 14 and second 16 truck mounting assemblies on bottom surface 38 of deck 12.

The twist-and-lock configuration described above can be configured to be generally sufficient to hold deck 12 in one piece and to mount first 14 and second 16 truck mounting assemblies on bottom surface 38 of deck 12. To better ensure that first 14 and second 16 truck mount assemblies stay in place on bottom surface 38 of deck 12, however, the preferred embodiment comprises a secondary locking or securing mechanism, best shown on FIGS. 2 through 4 as first securing mechanism 22 and second securing mechanism 24. In the preferred embodiment, each of the first 22 and second 24 securing mechanisms comprise a securing assembly 74 attached to bottom surface 38 of deck 12 and an outwardly extending member 76 on first 14 and second 16 truck assemblies. As set forth below, outwardly extending member 76 should be configured to be sufficiently resilient to facilitate secure engagement with securing assembly 74. In one embodiment, outwardly extending member 76 is made out of a polycarbonate material or other plastic, composite or metal materials. In the preferred embodiment, as shown in FIGS. 7 and 8, outwardly extending member 76 is generally configured as an L- or J-shaped member having an upper surface 78 and a lower surface 80 with a locking projection 82 thereon. Also in the preferred embodiment, securing assembly 74 comprises a securing base member 84 that is securely mounted to bottom surface 38 of deck 12 and which has a locking cavity 86 near the end thereof, as best shown in FIG. 3. In the preferred embodiment, locking projection 82 is a raised area of lower surface 80 of outwardly extending member 76 and locking cavity 86 is an aperture through base member 84. As explained in more detail below, locking projection 82 and locking cavity 86 should be cooperatively configured such that locking projection 82 will securely fit within locking cavity 86. In the preferred embodiment, the resilient nature of outwardly extending member 76 facilitates the engagement of locking projection 82 inside locking cavity 86 by allowing the user to push outwardly extending member 76 toward bottom surface 38 of deck 12 such that locking projection 82 can be rotated under base 84 until it is generally aligned with locking cavity 86, when the resilient nature of outwardly extending member 76 will push locking projection 82 into locking cavity 86.

Figure 9:
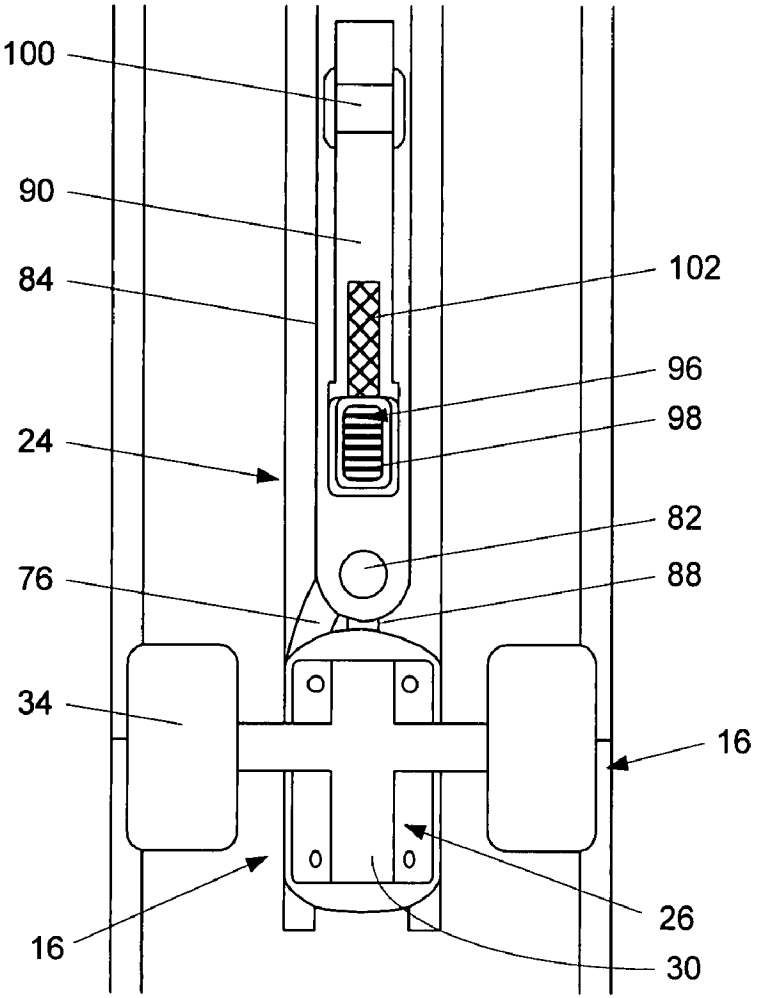
FIG. 9 is an isolated bottom plan view of the disassemblable skateboard of FIG. 2 showing the truck mounting assembly attached to the platform and secured into place by the locking and securing assemblies, with the locking assembly shown in the locked condition and the securing assembly shown in the secured condition.

The preferred embodiment of the skateboard 10 of the present invention also has an additional securing mechanism as part of first 22 and second 24 securing mechanisms, shown in FIGS. 2 through 4 and 9 through 12, to further ensure that first 14 and second 16 truck mounting assemblies are secured to the bottom surface of deck 12. This additional securing mechanism also utilizes base member 84 to slidably dispose securing extension member 88, best shown in FIGS. 10 through 12, toward first 14 or second 16 truck mounting assemblies. Securing extension member 88 is configured to slide in extension channel 90 of base member 84 so that extension member 88 can engage locking aperture 92 on a side 94 of truck mount 28 (shown in FIG. 7) to better secure first 14 or second 16 truck mounting assemblies to bottom surface 38 of deck 12. As shown in FIG. 9, securing extension member 88 slides under outwardly extending member 76 to prevent locking projection 82 from being disengaged from locking cavity 86. In one embodiment, extension member 88 slidably engages the upper surface 78 of outwardly extending member 76 to help displace locking projection 82 into locking cavity 86. A securing latch 96 generally at the end of securing extension member 88 is utilized to lock securing extension member 88 inside locking aperture 92 when it is desired to secure first 14 or second 16 truck mounting assemblies to deck 12. In the configuration shown in FIGS. 9 through 12, securing latch 96 is configured with a thumb or finger push plate 98 to assist the user with moving securing latch 96, and therefore securing extension member 88, from the locked condition (shown in FIG. 9) to the unlocked condition (shown in FIGS. 10 through 12) to disengage securing extension member 88 from locking aperture 92 so that first 14 or second 16 truck mounting assembly can be removed from deck 12. An enlarged portion of channel 90 is configured to receive push plate 98 such that it moves outwardly and cannot move into the narrow portion of channel 90 unless force, typically the user's thumb or finger, is applied to push plate 98 in the enlarged portion of channel 90 to allow securing latch 96 to be moved away from first 14 or second 16 truck mounting assembly, thereby disengaging extension member 88 from locking aperture 92. In this manner, it is unlikely that securing latch 96 will be accidently moved and extension member 88 inadvertently disengaged from locking aperture 92. Stop member 100 is utilized to stop the movement of securing latch 96 and extension member 88 past the point necessary to disengage extension member 88 from locking aperture 92.

To assist the user in recognizing whether the first 14 and/or second 16 truck mounting assemblies are secured by extension member 88, the preferred embodiment of the present invention utilizes a locked indicator 102 and an unlocked indicator 104. In the preferred embodiment, locked indicator 102 is located in channel 90 of base member 84 below the slidable extension member 88 and securing latch 96 and is not exposed unless push plate 98 of securing latch 96 is disposed in the enlarged portion of channel 90 and extension member 88 is engaged in locking aperture 92. When securing latch 96 is moved in channel 90 to disengage extension member 88 from locking aperture 92, locked indicator 102 will be covered up by extension member 88 and unlocked indicator 104, which is disposed on extension member 88, will become visible to warn the user that first 14 or second 16 truck mounting assembly is not secured by extension member 88. In one embodiment, locked indicator 102 is a patch or spot of green color and unlocked indicator 104 is a patch or spot of red color.

Figure 10:
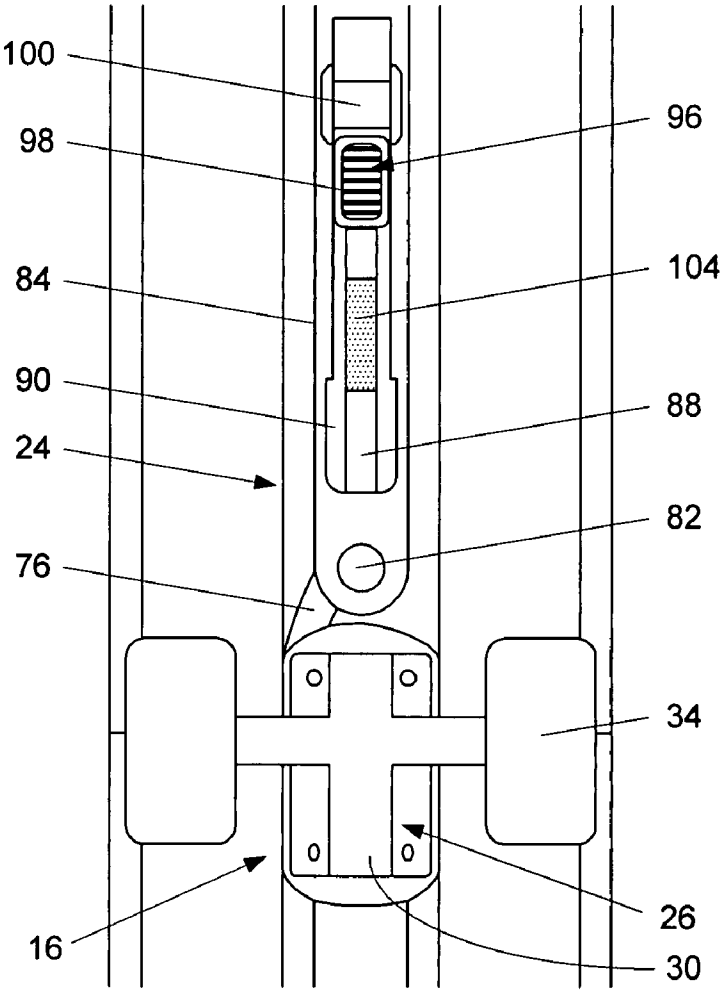
FIG. 10 is an isolated bottom plan view of the disassemblable skateboard of FIG. 9 with the locking assembly shown in the locked condition and the securing assembly shown in the unsecured condition.
Figure 12:
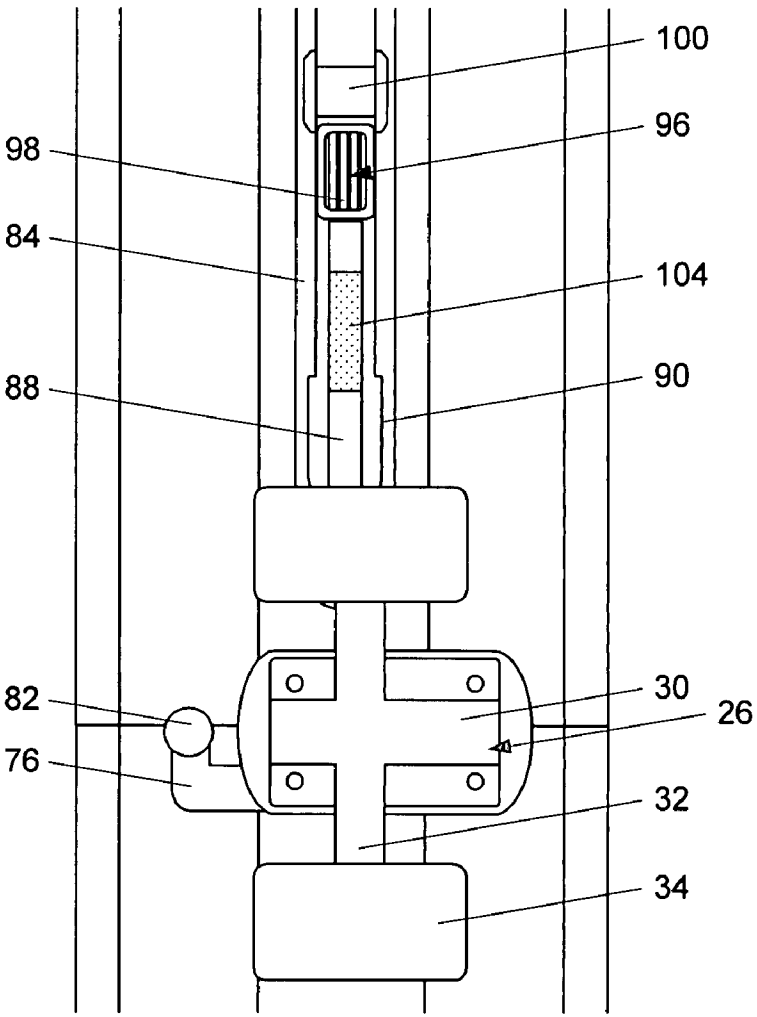
FIG. 12 is an isolated bottom plan view of the disassemblable skateboard of FIG. 11 shown with the truck mount assembly in position for removal from the platform.
Figure 11:
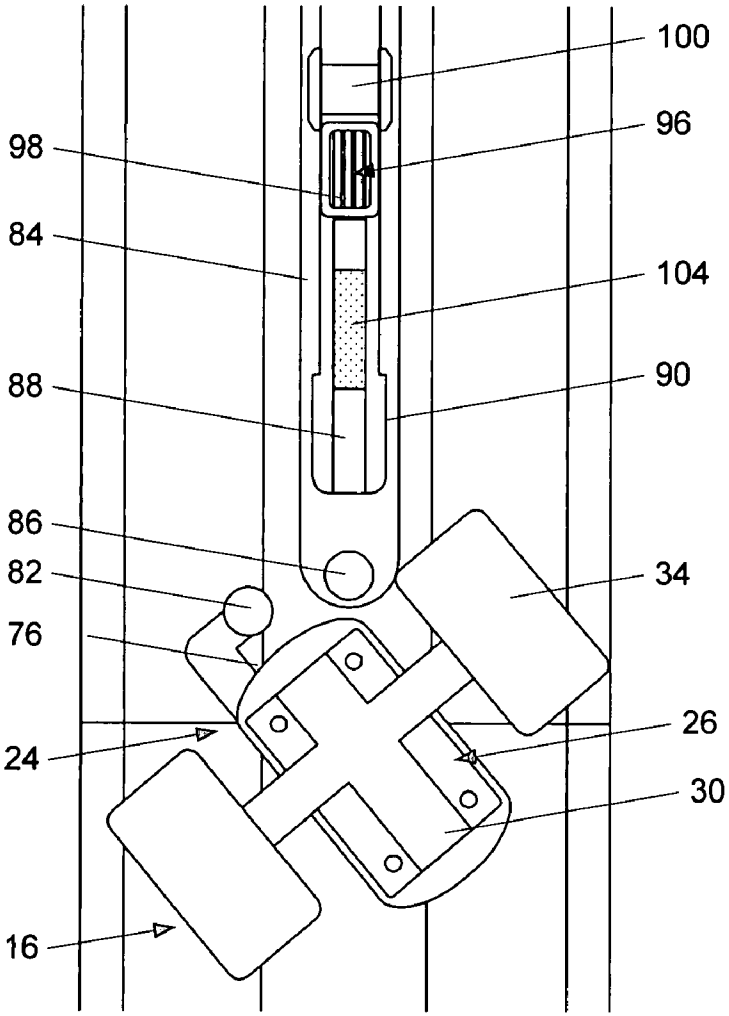
FIG. 11 is an isolated bottom plan view of the disassemblable skateboard of FIG. 10 with the truck mount assembly shown unlocked and disengaged from the locking assembly.

The operation of skateboard 10 of the preferred embodiment set forth above is shown in sequence, from locked condition to the unlocked ready to be removed condition, in FIGS. 9 through 12. In FIG. 9, second securing mechanism 24 is shown in the engaged or locked condition with truck mount 28 of second truck mounting assembly 16 mounted on second mounting mechanism 22 (not shown in FIG. 9) utilizing the twist-and-lock configuration described above, locking projection 82 of outwardly extending member 76 is engaged in locking cavity 86, securing latch 96 is at the enlarged portion of the channel 90 in base member 84, and extension member 88 is engaged inside locking aperture 92 of truck mount 28. Locked indicator 102 (i.e., a green colored area) is visible so as to indicate to the user that second securing mechanism 24 is in the secured or locked condition. As such, skateboard 10 is ready for riding or other use as, effectively, a single integral skateboard. In FIG. 10, securing latch 96 has been moved from the enlarged portion of channel 90, by pushing down on and sliding push plate 98, to a position at or near stop member 100 so as to withdraw or disengage extension member 88 from locking aperture 92. The locked indicator 102 (i.e., a red colored area) is covered by extension member 88 and the unlocked indicator 104 is displayed to indicate to the user that second securing mechanism 24 is not engaged. In FIG. 11, locking projection 82 on outwardly extending member 76 is disengaged from locking cavity 86, accomplished by pushing down on and twisting second truck mounting assembly 16, so as to begin the process of removing second truck mounting assembly 16 and truck assembly 26 from second mounting mechanism 22 (also not shown in FIG. 11). In this condition, receiving lips 70 of mounting cavity 68 on truck mounting assembly 16 are still partially engaged with projecting lips 72 on second truck mount connector 66, thereby preventing the complete removal of second truck mounting assembly 16 from deck 12. In FIG. 12, truck mount 28 of second truck mounting assembly 16 is completely twisted around on second truck mount connector 66 such that second truck mounting assembly 16 is ready to be removed from bottom surface 38 of deck 12. Once second truck mounting assembly 16 is lifted off of and removed from second truck mount connector 66, first end 54 of second end section 44 can be separated from second end 52 of center section 42. This same sequence is repeated for first truck mounting assembly 14 to separate first end section 40 from center section 42, thereby making it easier for the user to store and carry skateboard 10.

Figure 13:
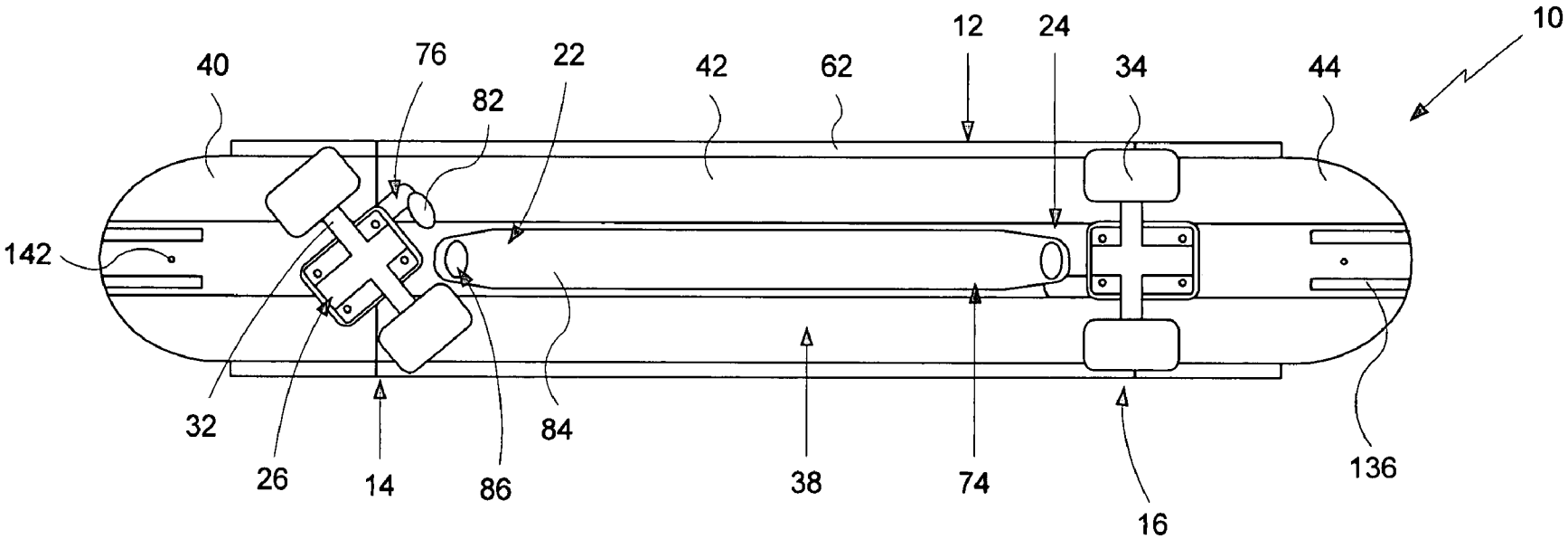
FIG. 13 is an alternative embodiment of the disassemblable skateboard of the present invention shown with the forward truck mounting assembly secured in place by the locking mechanism and the rearward truck mounting assembly unlocked and disengaged from the locking mechanism.
Figure 14:
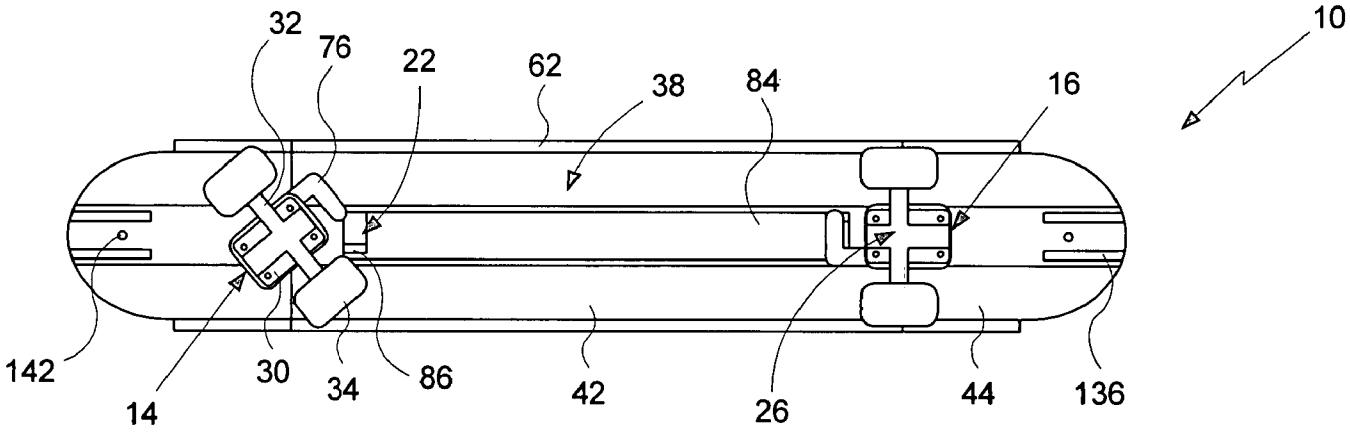
FIG. 14 is another alternative embodiment of the disassemblable skateboard of the present invention shown with the forward truck mounting assembly secured in place by the locking mechanism and the rearward truck mounting assembly unlocked and disengaged from the locking mechanism.

An alternative embodiment of the present invention is shown in FIG. 13. In this embodiment, most of the same features described above are also utilized. For instance, the same twist-and-lock arrangement are utilized for first 14 and second 16 truck mounting assemblies to mount to the first 18 and second 20 mounting mechanisms (not shown in FIG. 13) described above. Outwardly extending member 76 is basically configured the same except it has a generally oval shaped locking projection 82 that is shaped and configured to fit within like configured locking cavity 86, as shown for second truck mounting assembly 16. In this embodiment, securing assembly 74 comprises securing base member 84 with a locking cavity 86 at each end. The additional securing mechanism of the slidable extension member 88, used to more securely engage locking projection 82 in locking aperture 86, is not utilized in this embodiment. Likewise the locked 102 and unlocked indicators are also not utilized. As described above for the previous embodiment, deck 12 can be a single piece or it can comprise two or more deck sections, such as the three deck sections shown, for easier carrying and storage.

Figures 16, 17:
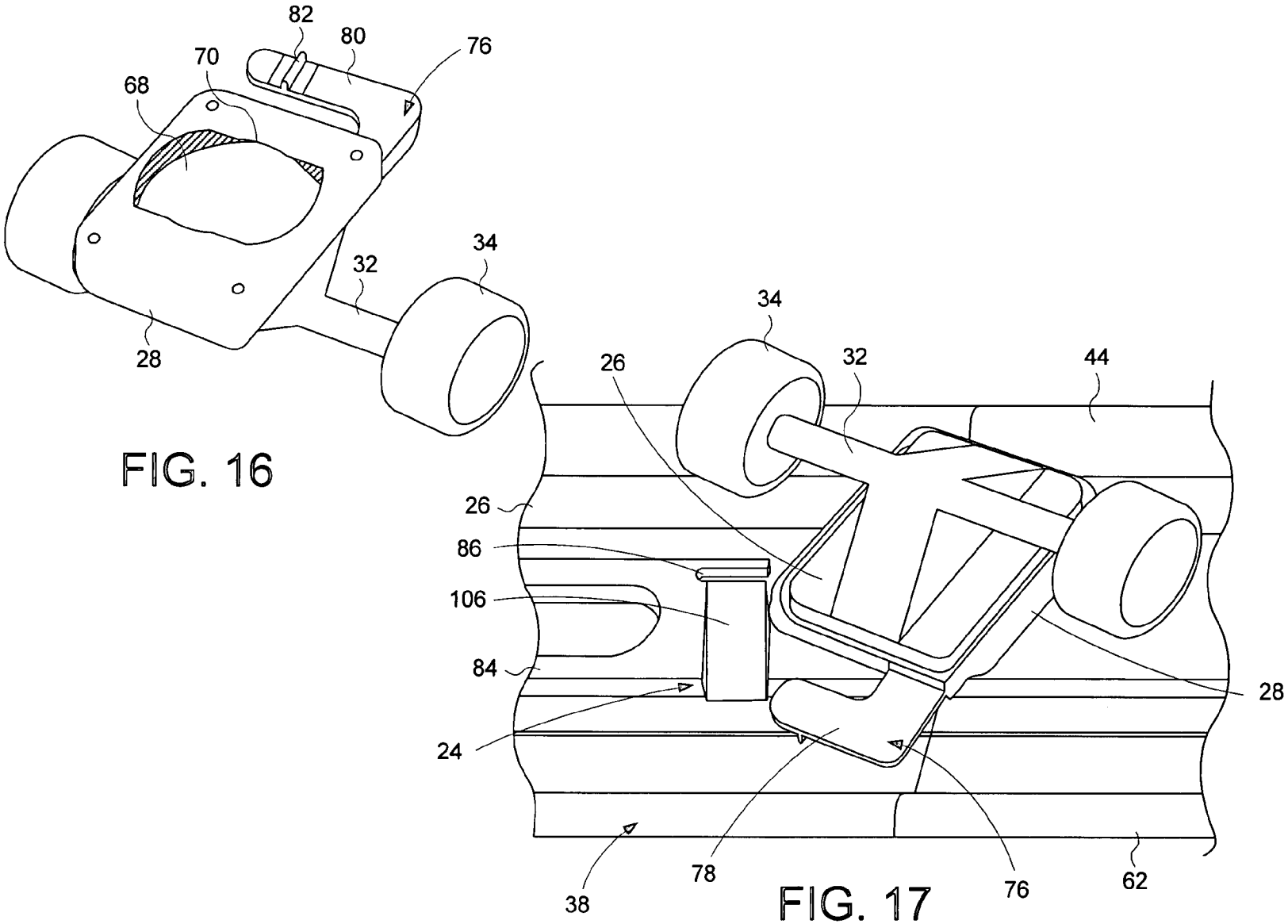
FIG. 16 is a top perspective view of the truck mounting assembly utilized with the embodiment of the disassemblable skateboard shown in FIG. 14.
FIG. 17 is a bottom perspective view of the truck mounting assembly for use with the disassemblable skateboard of FIG. 14 shown mounted on the platform but disengaged from the locking mechanism.

Another alternative embodiment is shown in FIGS. 14 through 17. In this embodiment, first 14 and second 16 truck mounting assemblies mount to first 18 and second 20 mounting mechanisms (not specifically shown), respectively, using the same twist-and-lock arrangement described in the above embodiments to mount to bottom surface 38 of deck 12 and to join first end section 40 to center section 42 and second end section 44 to center section 42. This embodiment also utilizes the outwardly extending member 76 attached to truck mount 28 having mounting cavity 68 configured to receive first 64 or second 66 mount connectors (shown in FIG. 15 as components 64*a*, 64*b*, 66*a* and 66*b*) therein for engagement of receiving lips 70 and projecting lips 72 to accomplish the "lock" part of the twist-and-lock arrangement. The difference with this embodiment is the configuration of first 22 and second 24 securing mechanisms, the placement of locking projection 82 and the manner in which locking projection 82 engages locking cavity 86. As best shown in FIGS. 16 and 17, in this embodiment locking projection 82 is located on the lower surface 80 of outwardly extending member 76 (instead of the upper surface 78, which can be generally planar in this embodiment) and first 22 and second 24 securing mechanisms have a ramp section 106 configured to direct outwardly extending member 76 toward locking cavity 86 for engagement with locking projection 82 therein. Ramp section 106 is an inclined section of securing base member 84 that takes advantage of the flexible or resilient nature of outwardly extending member 76 to obtain the engagement between truck mount 28 and first 22 or second 24 securing mechanisms. In use, as the user twists the first 14 or second 16 mounting assembly on first 64 or second 66 truck mount connector the locking projection 82 on outwardly extending member 76 will make contact with ramp section 106 of base member 84. As the first 14 or second 16 mounting assembly is twisted toward its engagement with first 18 or second 20 mounting mechanisms, the contact between locking projection 82 and ramp section 106 flexes or lifts outwardly extending member 76 until locking projection 82 drops into locking cavity 86, thereby preventing further rotation of first 14 or second 16 mounting assembly without first disengaging locking projection 82 from locking cavity 86. The flexible or resilient nature of outwardly extending member 76 will provide force to maintain engagement of locking projection 82 in locking cavity 86. At the same time, receiving lips 70 of mounting cavity 68 are engaged with projecting lips 72 of first 64 or second 66 truck connectors, thereby mounting first 14 or second 16 mounting assemblies on deck 12 and joining deck sections 40, 42 and 44 together to form a unified deck 12. The engagement of locking projection 82 in locking cavity 86 prevents further twisting (i.e., dismounting) of first 14 or second 16 mounting assemblies. For typical riding on skateboard 10, the above described engagement of locking projection 82 in locking cavity 86, as well as the twist-and-lock connection of first 14 or second 16 mounting assemblies, should be sufficient to maintain skateboard 10 in its assembled condition. If skateboard 10 is to be used for jumps, spins or other tricks it may be beneficial to include the additional securing mechanism described above with regard to the use of extension member 88 and its engagement with locking aperture 92 on truck mount 28.

Figure 21:
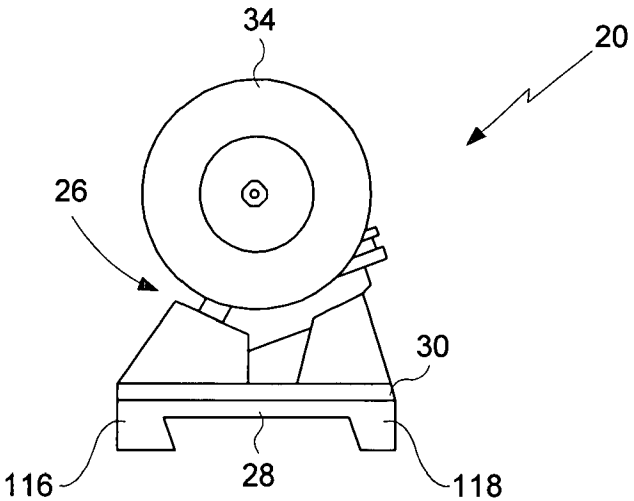
FIG. 21 is a side view of the truck mounting assembly showing the truck assembly and truck mount of the embodiment of the disassemblable skateboard used with the embodiment shown in FIG. 18.
Figure 22:
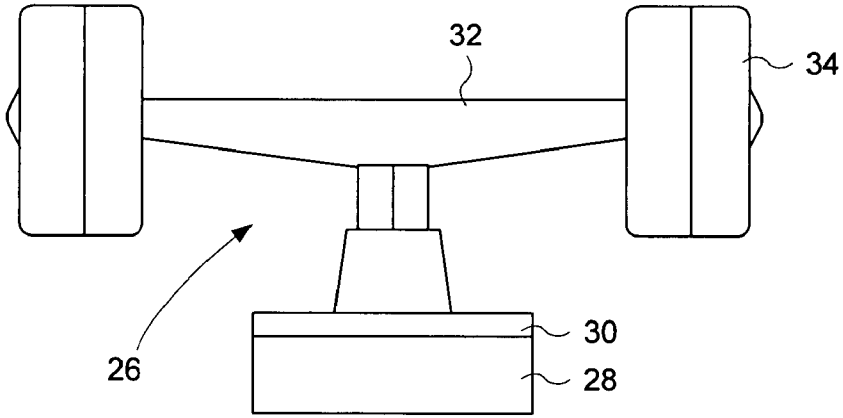
FIG. 22 is a front view of the truck mounting assembly of FIG. 21.
Figure 23:
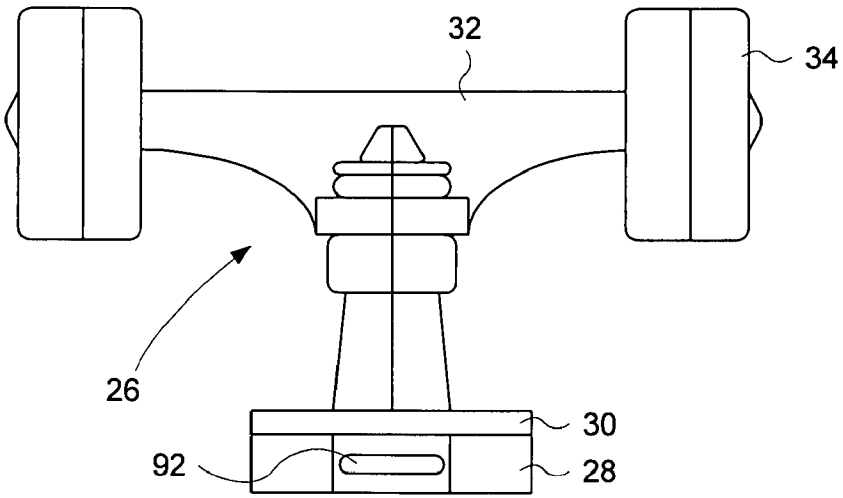
FIG. 23 is a rear view of the truck mounting assembly of FIG. 21.
Figure 24:
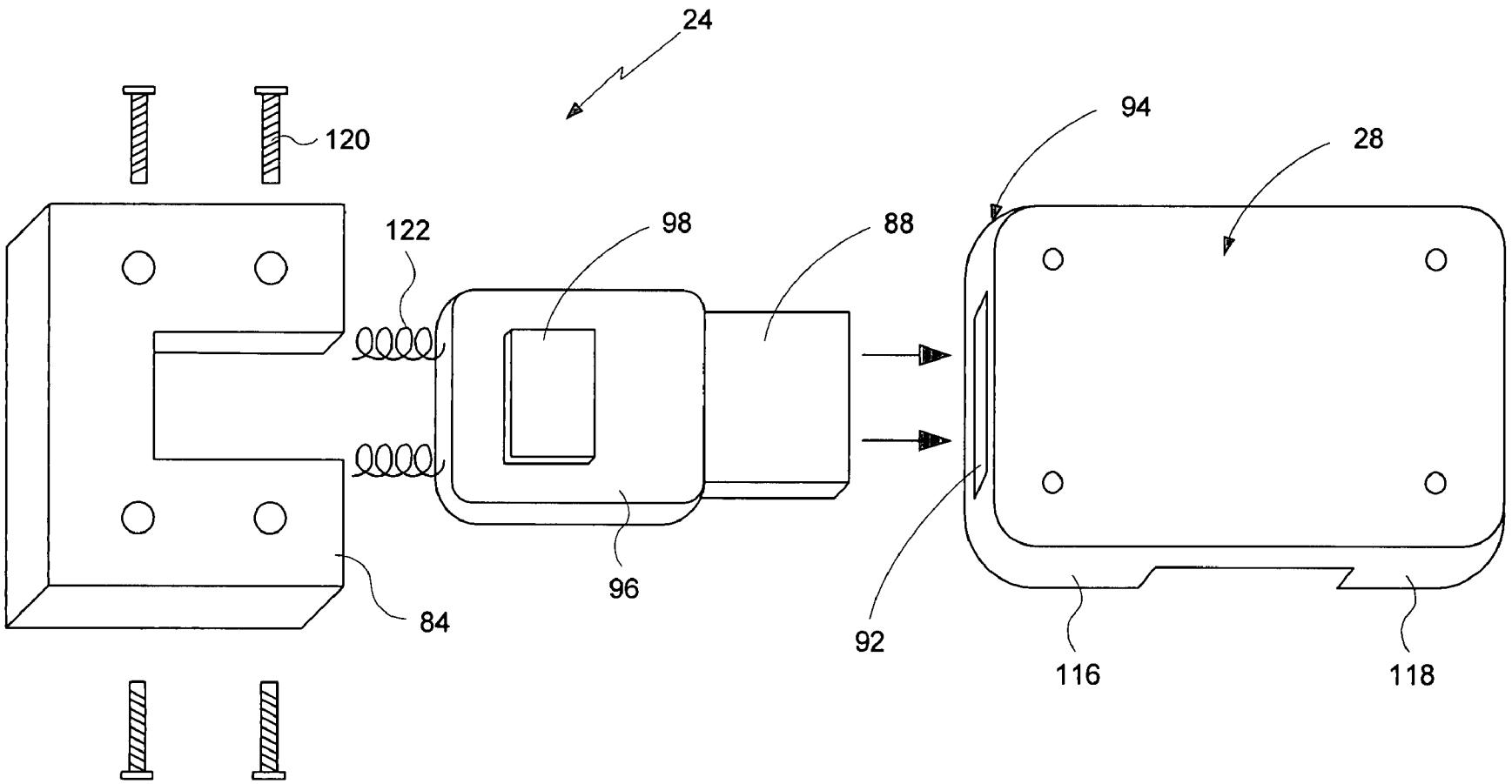
FIG. 24 is an exploded bottom perspective view of the locking assembly and truck mount of the embodiment of the disassemblable skateboard of FIG. 18.

Yet another embodiment of the skateboard 10 of the present invention is set forth in FIGS. 18 through 24. In this embodiment, pins 58 are positioned towards the centerline of deck 12, as opposed to being at the edges 62 of deck 12, and configured to be generally rectangular in cross-section to function as support tabs. Pins 58 are secured in a cavity of first 40 and second 44 end sections and secured in place by tab plates 108 secured to bottom surface 38 of deck 12 with a plurality of connecting elements, such as screws, bolt, rivets, adhesive and the like. Socket 60 is formed from a cavity at the first end 50 and second end 52 of center section 42 and supported by socket plates 110 so that pins or tabs 58 may be slidably received in socket 60 to form the unified deck 12 from deck sections 40, 42 and 44, much the same way as described in the embodiments above. In this embodiment, both first 18 and second 20 mounting mechanisms and first 22 and second 24 securing mechanisms are configured differently than described above. As best shown in FIGS. 20 and 21, first 18 and second 20 mounting mechanisms each comprise a first deck receptacle 112 and a second deck receptacle 114 on bottom surface 38 of deck 12 that are configured to engagedly receive, respectively, a first bracket extension 116 and a second bracket extension 118 which extend outwardly from truck mount 28, as best shown in FIG. 21. Preferably, first 112 and second 114 deck receptacles are shaped and configured such that when first 116 and second 118 bracket extensions are received therein, first 14 and second 16 mounting assemblies will be generally stable on deck 12 and, if deck 12 is provided in multiple sections (such as deck sections 40, 42 and 44), hold the deck sections together to form the unified deck 12. To secure first 14 or second 16 mounting assemblies to bottom surface 38 of deck 12 and the sections of deck 12 together, securing assembly 74 of first 22 and second 24 securing mechanisms of this embodiment comprises securing latch 96 having an extension member 88 thereon that is configured to be at least partially received in locking aperture 92 on truck mount 28, as best shown in FIG. 24, in much the same manner as described above. Securing latch 96 is configured to be slidably engaged by securing base member 84 such that extension member 88 can be slid toward base member 84 to disengage from locking aperture 92 so as to allow the user to remove first 14 or second 16 mounting assembly from deck 12. In a preferred embodiment, base member 84 forms a housing with one 'side, the side facing the truck mount 28, open to allow securing latch 96 to slidably move relative to base member 84. Base member 84 can be secured to bottom surface 38 of deck 12 with one or more connecting elements, such as screws 120 shown in FIG. 24, or by use of adhesive, welding or other appropriate mechanisms. In the preferred configuration of this embodiment, one or more springs 122 are disposed between base member 84 and securing latch 96 to bias securing latch 96, and therefore extension member 88, towards locking aperture 92 of truck mount 28 so that it may be engaged therein to prevent first 14 or second 16 mounting assembly from being inadvertently or unintentionally disengaged from deck 12. To remove first 14 or second 16 mounting assembly from deck 12, the user pushes against push plate 98 to move securing latch 96 with sufficient force to overcome springs 122 and slide extension member 88 out of locking aperture 92 on truck mount 28.

For each of the above-described embodiments, it is preferred that skateboard 10 be made out of materials that are lightweight to reduce the burden on the user when carrying skateboard 10 in a backpack or other carrying case and sufficiently durable, strong and corrosion resistant for use as a skateboard 10. In a preferred embodiment, most of the components are made out of a lightweight, strong metal, such as aluminum and the like, with outwardly extending member made out of sufficiently resilient plastic, such as the polycarbonate material described above. Truck assembly 26 can be configured and made out of materials commonly utilized for presently available skateboards, including the various materials which are known to be desirable for wheels 34. To further reduce the weight of skateboard 10, the preferred embodiment of deck 12 has one or more reduced mass areas 124, such as the three hash mark areas shown in FIG. 20. The areas shown as reduced mass areas 124 can have material removed from the thickness of deck 12 in a manner that reduces the weight of deck 12 without substantially reducing the strength of deck 12. The material for reduced mass areas 124 can be removed by routing or other means appropriate for the materials utilized for deck 12.

Figure 25:
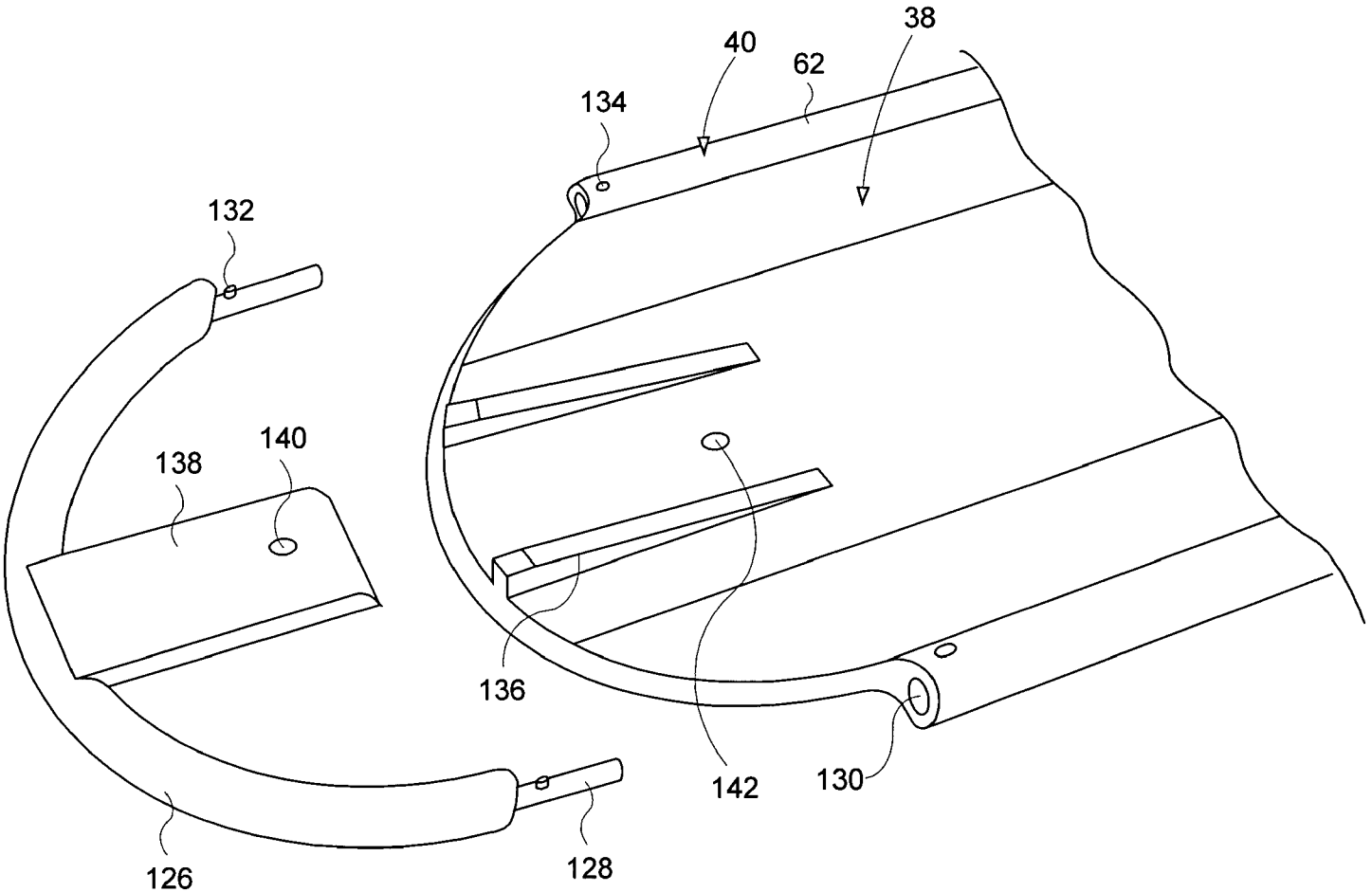
FIG. 25 is an exploded top perspective view of an end of the deck of the preferred embodiment of the present invention showing a configuration for the attachment of bumper guards to the deck.

The preferred embodiment of skateboard 10 of the present invention also utilizes bumper guards 126 at the opposing ends of deck 12, shown as first end 46 of first end section 40 and second end 56 of second end section 44 in the figures (i.e., FIGS. 1 through 4). In the preferred embodiment, as shown in FIG. 4, bumper guards 126 are removable from deck 12 so the user can replace them as needed or desired due to damage or upgrading. In a preferred embodiment, bumper guards 126 are made out of polyethylene or other plastic materials and are shaped and configured to tightly abut the ends 46 and 56 of deck 12. To secure bumper guards 126 to deck 12, a pin and socket connection is used (which is similar to that utilized to connect the deck sections together). As shown in FIG. 25, bumper pin 128 is configured to fit within bumper socket 130 so as to guide bumper guard 126 against the ends 46 and 56 of deck 12. To prevent bumper guards 126 from falling off or being knocked off, it is preferred that bumper guards 126 be secured to deck 12 with one or more bumper securing mechanism, such as those shown in FIG. 25. In one configuration, bumper pin 128 is provided with a bumper locking projection or protrusion. 132 that is received in and engaged by bumper aperture 134 that is in communication with bumper socket 130 such that when bumper pin 128 is received in bumper socket 130, bumper projection 132 will be received in bumper aperture 134 to hold bumper guard 126 tightly against ends 46 and 56 of deck 12. To assist with guiding and securing bumper guard 126 into place, the bottom surface 38 of deck 12 has a pair of bumper guides 136 and bumper guard 126 has an outward extending guide member 138 sized and configured to fit within bumper guides 136. To further secure bumper guard 126 to deck 12, guide member 138 has a first bumper hole 140 and bottom surface 38 has a correspondingly positioned second bumper hole 142 configured such that when bumper guard 126 is in place, with guide member 138 disposed between the pair of bumper guides 136, first bumper hole 140 is vertically aligned with second bumper hole 142 such that a screw or other connecting element, shown as 144 in FIGS. 2 and 3, can be inserted therein to secure guide member 138 to bottom surface 38 of deck 12 (i.e., first deck section 40 is shown in FIG. 25) to better secure bumper guard 126 to ends 46 and 56 of deck 12. As will be known to those skilled in the art, various other configurations are available for removably attaching bumper guards 126 to deck 12, including making bumper guards 126 integral with deck 12.

While there are shown and described herein certain specific alternative forms of the invention, it will be readily apparent to those skilled in the art that the invention is not so limited, but is susceptible to various modifications and rearrangements in design and materials without departing from the spirit and scope of the present invention. In particular, it should be noted that the present invention is subject to modification with regard to assembly, materials, size, shape and use. For instance, some of the components described above can be made integral with each other to reduce the number of separate components and various replacement components can be utilized that perform the same function as those described above.

What is claimed is:

1. A disassemblable skateboard, comprising:

a deck having a top surface and a bottom surface;

a truck mounting assembly having a truck assembly and a truck mount, said truck assembly having at least one axle and at least one wheel rotatably attached to said axle, said truck mount attached to or integral with said truck assembly, said truck mount having a mounting cavity;

means on said bottom surface of said deck for releasably mounting said truck mounting assembly to said deck, said mounting means configured to cooperatively engage said truck mount, said mounting means having an outwardly projecting truck mount connector, said mounting cavity of said truck mount shaped and configured to receive said truck mount connector therein and engage said truck mount connector so as to removably mount said truck mounting assembly to said bottom surface of said deck, said truck mount connector and said mounting cavity configured for twist-and-lock engagement; and means for securing said truck mounting assembly to said bottom surface of said deck, said securing means releasably interconnecting said bottom surface of said deck to said truck mount.

2. The disassemblable skateboard according to claim 1, wherein said deck comprises two or more deck sections comprising at least a first deck section disposed in adjacent abutting relation to a second deck section, said first deck section configured to be separated from said second deck section to disassemble said deck, said first deck section and said second deck section cooperatively configured to be joined in locking engagement to assemble said deck.

3. The disassemblable skateboard according to claim 2, wherein said mounting means is configured to join said first deck section to said second deck section.

4. The disassemblable skateboard according to claim 1, wherein said truck mount connector comprises at least one projecting lip thereon and said mounting cavity comprises at least one receiving lip thereon, said projecting lip configured to engage said receiving lip to mount said truck mounting assembly to said bottom surface of said deck.

5. The disassemblable skateboard according to claim 1, wherein said securing means comprises an outwardly extending member on said truck mounting assembly and a securing assembly on said bottom surface of said deck, said securing assembly configured to cooperatively engage said outwardly extending member and secure said truck mounting assembly to said deck.

6. The disassemblable skateboard according to claim 5, wherein said securing assembly comprises a securing base member mounted to said bottom surface of said deck, said securing base member configured to engage said outwardly extending member.

7. The disassemblable skateboard according to claim 6, wherein securing assembly further comprises a securing extension member, said securing extension member slidably disposed in said securing base member and extending toward said truck mount, said truck mount having a locking aperture on a side of said truck mount, said locking aperture configured to receive said securing extension member therein.

8. The disassemblable skateboard according to claim 7, wherein said securing extension member extends outwardly from a securing latch, said securing latch slidably engaged with said securing base member to lock said securing extension member in said locking aperture.

9. The disassemblable skateboard according to claim 6, wherein said outwardly extending member is sufficiently resilient so as to generally displace said outwardly extending member into engagement with said securing base member.

10. The disassemblable skateboard according to claim 9, wherein said securing base member comprises a locking cavity and said outwardly extending member comprises a cooperatively configured locking projection, said locking cavity configured to receive said locking projection therein.

11. The disassemblable skateboard according to claim 10, wherein said securing assembly further comprises a ramp section on said securing base member, said ramp section configured to guide said locking projection into said locking cavity.

12. The disassemblable skateboard according to claim 10, wherein securing assembly further comprises a securing extension member, said securing extension member slidably disposed in said securing base member and extending toward said truck mount, said truck mount having a locking aperture on a side of said truck mount, said locking aperture configured to receive said securing extension member therein.

13. The disassemblable skateboard according to claim 12, wherein said securing extension member extends outwardly from a securing latch, said securing latch slidably engaged with said securing base member to lock said securing extension member in said locking aperture.

14. The disassemblable skateboard according to claim 1, wherein said securing means comprises a securing assembly on said bottom side of said deck, said securing assembly configured to engage said truck mount.

15. The disassemblable skateboard according to claim 14, wherein said securing assembly comprises a securing base member and a securing extension member, said securing extension member extending toward said truck mount, said truck mount having a locking aperture on a side of said truck mount, said locking aperture configured to receive said securing extension member therein.

16. The disassemblable skateboard according to claim 15, wherein said securing extension member extends outwardly from a securing latch, said securing latch slidably engaged with said securing base member.

17. The disassemblable skateboard according to claim 1, wherein said mounting means comprises one or more deck receptacles and said truck mount comprises one or more outwardly projecting bracket extensions, each of said one or more deck receptacles cooperatively configured to engagingly receive one of said one or more bracket extensions therein so as to mount said truck mounting mechanism on said deck.

18. The disassemblable skateboard according to claim 17, wherein said mounting means comprises a first deck receptacle and a second deck receptacle and said truck mount comprises a first outwardly projecting bracket extension and a second outwardly projecting bracket extension, said first deck receptacle and said first bracket extension cooperatively configured for said first deck receptacle to engagingly receive said first bracket extension and said second deck receptacle and said second bracket extension cooperatively configured for second deck receptacle to engagingly receive said second bracket extension so as to mount said truck mounting mechanism on said deck.

19. The disassemblable skateboard according to claim 18, wherein said securing means comprises a securing assembly on said bottom side of said deck, said securing assembly configured to engage said truck mount.

20. The disassemblable skateboard according to claim 19, wherein said securing assembly comprises a securing base member and a securing extension member, said securing extension member extending toward said truck mount.

21. The disassemblable skateboard according to claim 20, wherein said truck mount has a locking aperture on a side of said truck mount, said locking aperture configured to receive said securing extension member.

22. The disassemblable skateboard according to claim 21, wherein said securing extension member extends outwardly from a securing latch, said securing latch slidably engaged with said securing base member.

23. The disassemblable skateboard according to claim 22, wherein said securing assembly further comprises one or more springs disposed between said securing latch and said securing base member, said one or more springs configured to bias said securing extension member into said locking aperture when said truck mount is mounted on said bottom surface of said deck.

24. The disassemblable skateboard according to claim 1, wherein said deck comprises two or more deck sections, said mounting means configured to join said two or more deck sections in abutting relationship.

25. The disassemblable skateboard according to claim 24, wherein said deck comprises a first end section, a second end section and a center section disposed between said first end section and said second end section.

26. The disassemblable skateboard according to claim 25, wherein said mounting means comprises a first mounting means on said deck configured to mount a first truck mounting assembly to said bottom surface of said deck so as to abuttingly join a second end of said first end section to a first end of said center section and a second mounting means on said deck configured to mount a second truck mounting assembly to said bottom surface of said deck so as to abuttingly join a first end of said second end section to a second end of said center section.

27. A disassemblable skateboard, comprising:

a deck having a top surface and a bottom surface, said deck comprising two or more deck sections;

a truck mounting assembly having a truck assembly and a truck mount, said truck assembly having at least one axle and at least one wheel rotatably attached to said axle, said truck mount attached to or integral with said truck assembly, said truck mount having a mounting cavity;

a truck mount connector on said bottom surface of said deck, said truck mount connector configured to be received in said mounting cavity and cooperatively engage said truck mount so as to releasably mount said truck mounting assembly to said deck and abuttingly join two of said two or more deck sections together; and means for securing said truck mounting assembly to said bottom surface of said deck, said securing means releasably interconnecting said bottom surface of said deck to said truck mount.

28. The disassemblable skateboard according to claim 27, wherein said truck mount connector comprises two or more connector components, at least one of said connector components on each of said deck sections, said mounting cavity of said truck mount configured to hold said connector components together so as to abuttingly join said deck sections.

29. The disassemblable skateboard according to claim 28, wherein said deck comprises a first end section, a second end section and a center section disposed between said first end section and said second end section, said first end section having one of said connector components in opposing relation to one of said connector components on said center section and said second end section having one of said connector components in opposing relation to one of said connector components on said center section, said skateboard having a first truck mounting assembly and a second mounting assembly, said first truck mounting assembly configured to receive said connector components on said first end section and the connector component in opposing relation thereto on said center section so as to abuttingly join said first end section and said center section, said second truck mounting assembly configured to receive said connector components on said second end section and the connector component in opposing relation thereto on said center section so as to abuttingly join said second end section and said center section.

30. The disassemblable skateboard according to claim 27, wherein said truck mount and said truck mount connector are configured for twist-and-lock engagement.

31. The disassemblable skateboard according to claim 27, wherein said securing means comprises an outwardly extending member on said truck mounting assembly and a securing assembly on said bottom surface of said deck, said securing assembly configured to cooperatively engage said outwardly extending member and secure said truck mounting assembly to said deck.

32. The disassemblable skateboard according to claim 31, wherein said outwardly extending member is sufficiently resilient so as to generally displace said outwardly extending member into engagement with said securing assembly.

33. The disassemblable skateboard according to claim 32, wherein said securing assembly comprises a locking cavity and said outwardly extending member comprises a cooperatively configured locking projection, said locking cavity configured to receive said locking projection therein.

34. The disassemblable skateboard according to claim 33, wherein said securing assembly further comprises a ramp section, said ramp section configured to guide said locking projection into said locking cavity.

35. The disassemblable skateboard according to claim 33, wherein securing assembly further comprises a securing extension member and a securing base member, said securing extension member slidably disposed in said securing base member and extending toward said truck mount, said truck mount having a locking aperture on a side of said truck mount, said locking aperture configured to receive said securing extension member therein.

36. The disassemblable skateboard according to claim 35, wherein said securing extension member extends outwardly from a securing latch, said securing latch slidably engaged with said securing base member to lock said securing extension member in said locking aperture.

37. A disassemblable skateboard, comprising:

a deck having a top surface and a bottom surface;

a truck mounting assembly having a truck assembly and a truck mount, said truck assembly having at least one wheel rotatably attached thereto, said truck mount attached to or integral with said truck assembly;

a truck mount connector on said bottom surface of said deck, said truck mount connector configured to cooperatively engage said truck mount so as to releasably mount said truck mounting assembly to said deck, said truck mount connector and said truck mount cooperatively configured for twist-and-lock engagement; and means for securing said truck mounting assembly to said deck.

38. The disassemblable skateboard according to claim 37, wherein said truck mount has a mounting cavity and said truck mount connector is configured to be received in said mounting cavity.

39. The disassemblable skateboard according to claim 37, wherein said deck comprises at least a first deck section disposed in adjacent abutting relation to a second deck section, said first deck section configured to be separated from said second deck section to disassemble said deck, said first deck section and said second deck section cooperatively configured to be joined in locking engagement to assemble said deck

40. The disassemblable skateboard according to claim 39, wherein said truck mount and said truck mount connector are configured to join said first deck section to said second deck section.

41. The disassemblable skateboard according to claim 40, wherein said truck mount has a mounting cavity and said truck mount connector is configured to be received in said mounting cavity.

42. A disassemblable skateboard, comprising:

a deck having a top surface and a bottom surface, said deck comprising at least a first deck section disposed in adjacent abutting relation to a second deck section, said first deck section configured to be separated from said second deck section to disassemble said deck, said first deck section and said second deck section cooperatively configured to be joined in locking engagement to assemble said deck;

a truck mounting assembly having a truck assembly and a truck mount, said truck assembly having at least one wheel rotatably attached thereto, said truck mount attached to or integral with said truck assembly;

a truck mount connector on said bottom surface of said deck, said truck mount connector configured to cooperatively engage said truck mount so as to releasably mount said truck mounting assembly to said deck;

means for securing said truck mounting assembly to said deck, said means for securing releasably securing said truck mount connector to said truck mount; and wherein said truck mount connector and said truck mount are cooperatively configured for twist-and-lock engagement.

43. The disassemblable skateboard according to claim 42, wherein said truck mount has a mounting cavity and said truck mount connector is configured to be received in said mounting cavity.

44. The disassemblable skateboard according to claim 43, wherein said truck mount connector and said mounting cavity are cooperatively configured for twist-and-lock engagement.

45. The disassemblable skateboard according to claim 42, wherein said means for securing comprises an outwardly extending member on said truck mounting assembly and a securing assembly on said bottom surface of said deck, said securing assembly configured to cooperatively engage said outwardly extending member and secure said truck mounting assembly to said deck, said outwardly extending member being sufficiently resilient so as to generally displace said outwardly extending member into engagement with said securing assembly.

46. The disassemblable skateboard according to claim 45, wherein said securing assembly comprises a locking cavity and said outwardly extending member comprises a cooperatively configured locking projection, said locking cavity configured to receive said locking projection therein.

* * * * *